US005920155A

United States Patent [19]

Kanda et al.

[11] Patent Number: 5,920,155

[45] Date of Patent: Jul. 6, 1999

[54] ELECTRONIC BALLAST FOR DISCHARGE LAMPS

[75] Inventors: Takashi Kanda; Kazuo Yoshida; Masahiro Naruo; Kazuhiro Hori; Masahito Ohnishi, all of Kadoma, Japan

[73] Assignee: Matsushita Electric Works, Ltd., Osaka, Japan

[21] Appl. No.: 08/958,326

[22] Filed: Oct. 27, 1997

[30] Foreign Application Priority Data

Oct. 28, 1996 [JP] Japan ..... 8-285371
Oct. 28, 1996 [JP] Japan ..... 8-303740

[51] Int. Cl.[6] ..... G05F 1/00

[52] U.S. Cl. ..... 315/307; 315/307; 315/209 R; 315/244; 315/DIG. 4; 363/157

[58] Field of Search ..... 315/105, 244, 315/209 R, 291, 307, 224, DIG. 4; 363/8, 37, 98, 124, 157

[56] References Cited

U.S. PATENT DOCUMENTS 4,933,605 6/1990 Quazi et al. ..... 315/224
5,063,490 11/1991 Maehara et al. ..... 315/307 X
5,434,479 7/1995 Ohnishi et al. ..... 315/209 R

*Primary Examiner*—Don Wong
*Assistant Examiner*—Haissa Philogene
*Attorney, Agent, or Firm*—Burns, Doane, Swecker & Mathis, L.L.P.

[57] ABSTRACT

An electronic ballast for discharge lamps comprises a main resonance circuit for applying a voltage necessary for operating of a discharge lamp having filaments to both ends of the discharge lamp and a filament resonance circuit for supplying a filament current to the filaments, wherein the main resonance circuit and filament resonance circuit have resonance circuits having different resonance characteristics in an output path leading to the discharge lamp and also change their outputs depending on an operating frequency of switching elements. Thereby a filament current and a voltage across the discharge lamp can be set at suitable one of respective operational modes of the discharge lamp according to an operational state of the discharge lamp.

27 Claims, 37 Drawing Sheets

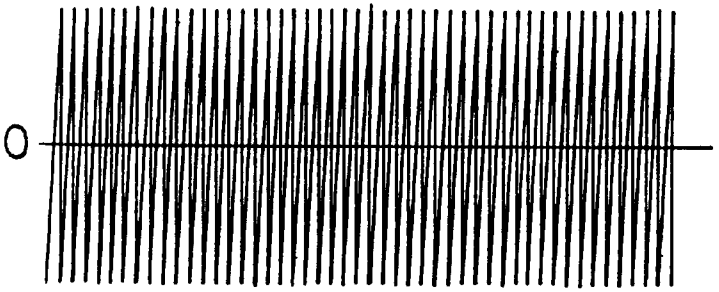
FIG. 25(a)
FIG. 25(b)
FIG. 25(c)
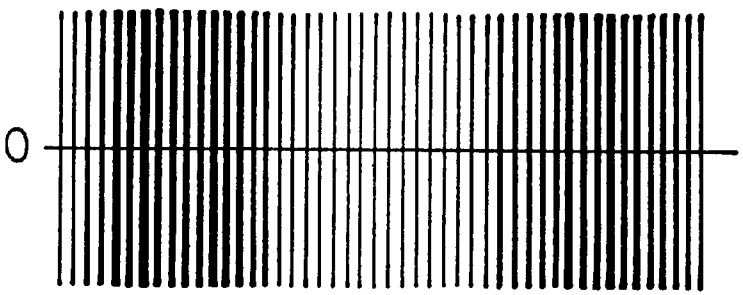
FIG. 25(d)
FIG. 25(e)
FIG. 25(f)

ELECTRONIC BALLAST FOR DISCHARGE LAMPS

BACKGROUND OF THE INVENTION

The present invention relates to electronic ballast for discharge lamps and more particularly, to an electronic ballast for discharge lamps which can suppress an upper limit of a filament current in a dimming mode of a discharge lamp.

DESCRIPTION OF RELATED ART

This type of prior art electronic ballast system for operating a discharge lamp having filaments at a high frequency include U.S. Pat. No. 4,352,456. In this U.S. Patent, an electronic ballast system for discharge lamps includes an inverter circuit for converting an A.C. input to a D.C. output and converting the D.C. output to a high frequency power. An output of the inverter circuit is applied to both ends of a lamp through an inductor contributing to resonance, and a capacitor contributing to resonance is connected between both non-power side ends of filaments. This U.S. patent is arranged so that, when the lamp is not lit, more current flows through the resonating capacitor to supply a large preheating current to the filaments; whereas, after the lamp is lit, the impedance of the lamp is reduced to reduce the current flowing through the resonating capacitor and to reduce the filament preheating current, thereby reducing a filament loss in an operating mode. However, the U.S. patent has a problem that the invention has no dimming function and it is difficult to control the preheating current.

Prior art electronic ballasts for discharge lamps for operating a discharge lamp having filaments at a high frequency and having a dimming function include U.S. Pat. No. 4,933,605. In this U.S. patent, dimming is possible, and a resonating capacitor is inserted between both non-power-side ends of the filaments to control a preheating current in a prior preheating mode and in an operating mode. However, the invention has no function of optimumly controlling the preheating current between a normal operating mode and dimming mode.

Also disclosed as another prior art is Japanese Patent Application Laid-Open Publication No. 61-296697. The prior art is arranged to be able to perform its continuous dimming operation of a discharge lamp having filaments. That is, an inverter circuit is provided to convert an A.C. input to a D.C. output and further to convert the D.C. output to a high frequency power, and a lighting resonance circuit for supplying a power to the lamp as well as a preheating resonance circuit for supplying a power to the filament are connected to the inverter circuit. The inverter circuit, which is controlled by an oscillation circuit having a variable frequency, operates at a high frequency in a prior preheating mode and operates at a frequency lower than the high frequency in an operating mode. The preheating resonance circuit is set so as to supply a large power to the lamp filaments in the vicinity of the high frequency in the prior preheating mode, whereas the lighting resonance circuit is set so as to supply a sufficient power to the lamp at the low frequency in the operating mode. Further, when the oscillation frequency is increased in the operating mode, the lighting resonance circuit reduces its output for dimming, whereas, the preheating resonance circuit increases its output to increase the preheating current. Accordingly, as the dimming level becomes low, the preheating current increases, thus enabling prolongation of a life of the lamp.

However, in the case of such a slim lamp as, e.g., a T5 lamp, its filament part is made small so that the life of the lamp cannot be prolonged unless an electrode current including a lamp current and a filament current is controlled. Thus, it is necessary in a dimming mode to prescribe the preheating current at a level that is higher than that in a normal operating mode and is smaller than that in the prior preheating mode. In this prior art, it has been impossible to satisfy such prescribed upper limit requirement of the preheating current in the dimming mode and it has been difficult to dim such a slim lamp as the T5 lamp while securing its prolonged life.

SUMMARY OF THE INVENTION

It is therefore an object of the present invention to provide an electronic ballast for discharge lamps which can set a filament current and a voltage across a discharge lamp at their suitable operational levels according to respective operational states of the discharge lamp, and also which can have a sufficient dimming function even when the lamp is of a slim type.

In accordance with an aspect of the present invention, the above object is attained by providing an electronic ballast for discharge lamps which comprises a main inverter including a plurality of switching elements and a main resonance circuit connected to an output path leading to a discharge lamp having a plurality filaments, for supplying a voltage necessary for operating of the discharge lamp by driving the plurality of switching elements; and a filament preheating inverter for supplying a preheating current to the filaments by driving the plurality of switching elements, and wherein output frequency characteristics of the main inverter and filament preheating inverter are set so that an operating frequency of the filament preheating inverter when the filament current in a dimming mode of the discharge lamp reaches a predetermined upper limit becomes equal to or higher than an operating frequency of the main inverter when an optical output in a dimming mode of the discharge lamp becomes a lower limit.

Other objects and advantages of the present invention will become apparent from the following detailed description of preferred embodiments thereof in connection with the accompanying drawings.

BRIEF DESCRIPTION OF THE DRAWINGS

FIGS. 25*a* to 25*f* are diagrams for explaining the operations of parts in the embodiment 13 of FIG. 23 respectively.

Figure 1:
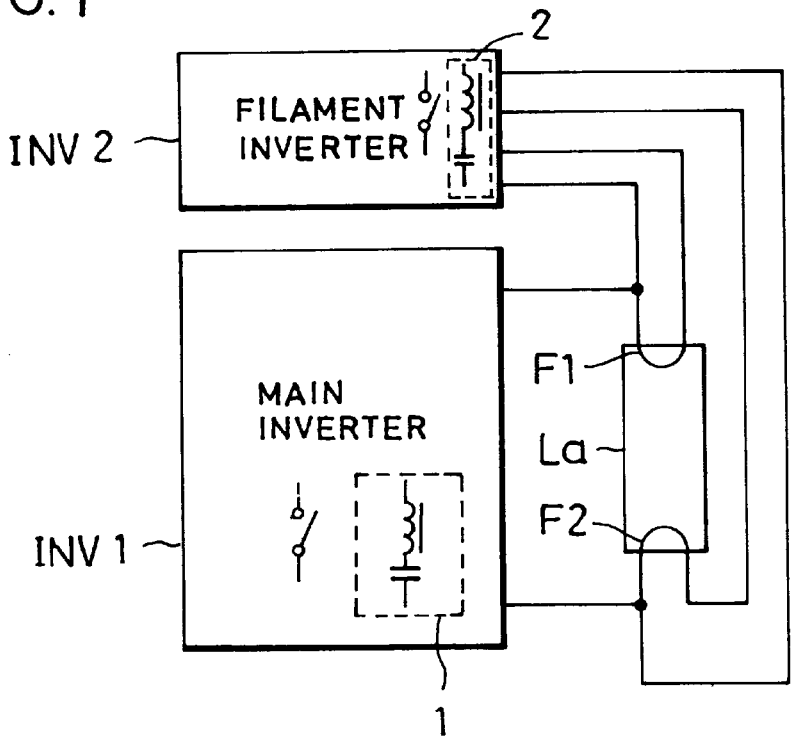
FIG. 1 is a basic arrangement of an electronic ballast for discharge lamps in accordance with the present invention.

While the present invention will now be described with reference to the embodiments shown in the drawings, it should be appreciated that the intention is not to limit the present invention only to these embodiments shown but to include all alterations, modifications and equivalent arrangements possible within the scope of appended claims.

DETAILED DESCRIPTION OF THE PREFERRED EMBODIMENTS

A basic arrangement of an electronic ballast for discharge lamps in accordance with the present invention is shown in FIG. 1. The illustrated device comprises a main inverter INV1 for supplying operating power to a discharge lamp La and a filament inverter INV2 for preheating filaments F1 and F2 of the discharge lamp La. The main inverter INV1 and filament inverter INV2 controls an operating frequency (that is, output frequency) of a switching element to thereby change the power to be supplied to the discharge lamp La.

Meanwhile, as lighting fixtures are made smaller in size and lamps are made higher in its efficiency and smaller in use resource amount, fluorescent lamps have tended to have slim tubes. A lamp impedance of this type of lamp per unit length excluding lamp caps tends to be larger as the diameter of the tube becomes smaller, when compared with the same type of lamp (e.g., FL20S and FL20SS/18) as shown in Table 1 attached herein. In particular, such a T5 lamp (or 'TL'5 (trade name of Phillips Ltd.)) as T5-14, T5-21, T5-28 or T5-35 having a tube diameter of 16 mm has a lamp impedance per unit length excluding the lamp caps of 8Ω/cm or more, which impedance is larger than that of such a prior art lamp as a lamp (e.g., FL20S, FL20SS/18, FL30S, FL40S/38, FL40SS/37, etc.) having tube diameters of 28–32.5 mm or as a high frequency operating lamp (e.g., FHF16, FHF16-23, FHF32, FHF32-45, etc.) having a tube diameter of 25.5 mm.

Further, with such types of slim lamps, it is impossible to realize a long lamp life unless a filament part is made small to control an electrode current including a lamp current and a filament current. Accordingly, a preheating current in a dimming mode is required to be prescribed at a value larger than in a normal operating mode but smaller than in a prior preheating mode. In the prior art capacitor preheating system, for this reason, it is difficult to satisfy both filament current conditions in the preheating mode and conditions of lamp voltage and/or filament current in the normal operating mode or dimming mode at the same time. The present invention is usefully applied, in particular, to such a type of lamp.

Figure 2:
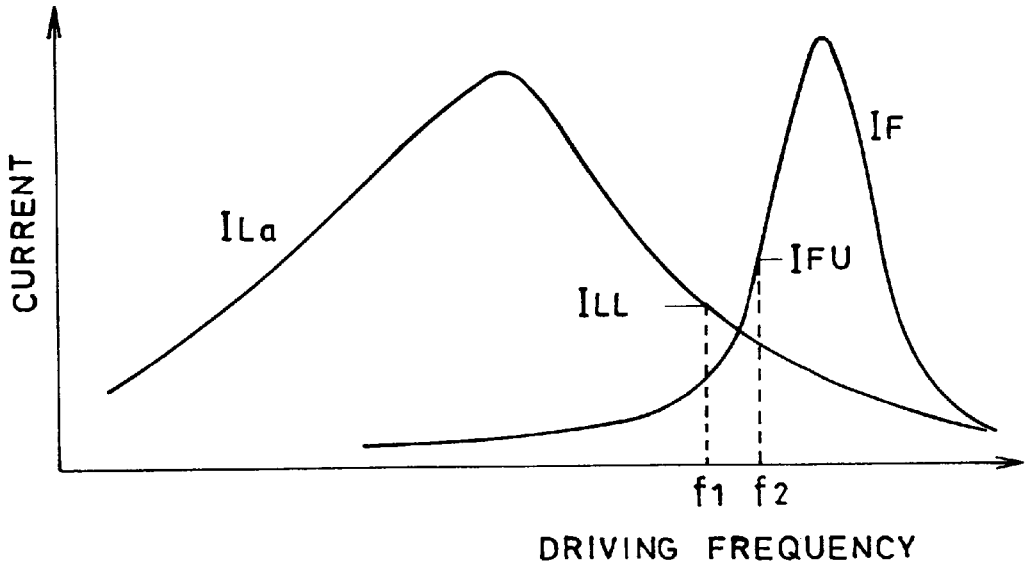
FIG. 2 is a load current characteristic diagram with respect to an operating frequency for the device of FIG. 1.

Characteristics of the main inverter INVL and filament inverter INV2 showing a relationship between load current and operating frequency is set as shown in FIG. 2. That is, an operating frequency corresponding to a peak value in a filament current IF is set to be higher than an operating frequency corresponding to a peak value in a lamp current ILa. Further, an operating frequency f2 of the filament inverter INV2 corresponding to an upper limit IFU of the filament current IF in the dimming mode is set to be equal to or higher than an operating frequency f1 of the main inverter INVL corresponding to a lower limit ILL of the lamp current ILa in the dimming mode (f1<f2).

Therefore, when the main inverter INVL and filament inverter INV2 are operated at the same operating frequency, the main inverter INVL and filament inverter INV2 will operate at an operating frequency of the operating frequency f1 or less, whereby the filament current IF will be necessarily equal to or lower than the upper limit IFU. In this case, the arrangement of the main inverter INVL and filament inverter INV2 is not specifically restricted. Thus, the arrangement may be of a half bridge type, full bridge type, one solid-state transistor type or any type, so long as the arrangement enables change of an output power by controlling the operating frequency. Further, since the operating frequency of the main inverter INVL is equal to that of the filament inverter INV2, the both inverters can share a power supply and a switching element.

In the case of the discharge lamp La of a slim tube, however, the upper limit IFU of the filament current IF in the dimming mode is required to be lower than the lower limit IFL of the filament current IF in the preheating mode. In this case, the operating frequency in the preheating mode is set at a value f4 higher than the operating frequency f2 at which the upper limit IFU of the filament current IF is obtained in the dimming mode, as shown in FIG. 3*a* (f2<f4).

Figures 3A, 3B:
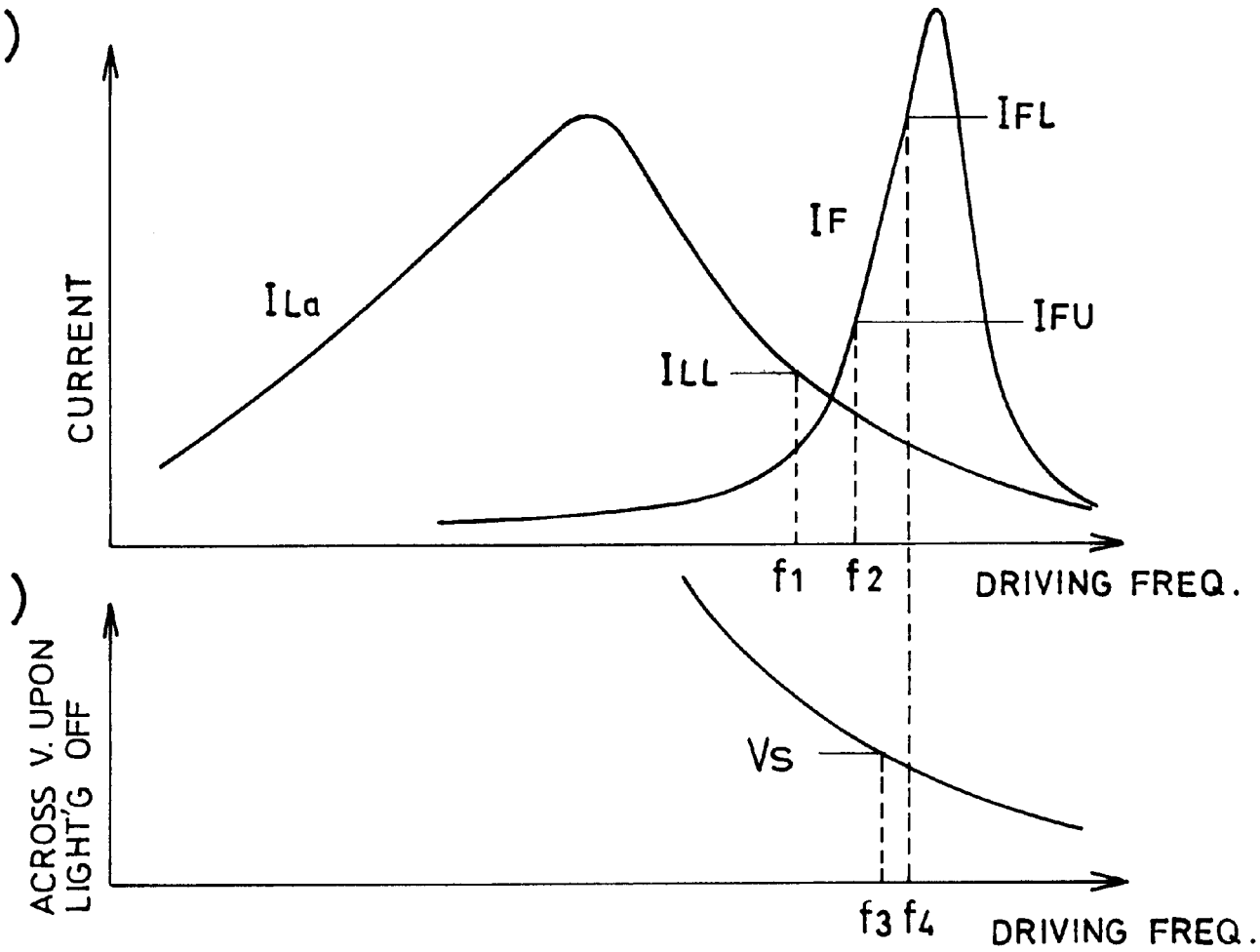
FIGS. 3*a* and 3*b* are frequency diagrams of the device of FIG. 1 respectively.

Shown in FIG. 3*b* is a characteristic diagram showing a relationship between a across-ends voltage VLa applied across the discharge lamp La from the main inverter INV1 and the operating frequency. The across-ends voltage VLa of the discharge lamp La is required to be lower than an ignition voltage VS in the preheating mode. Thus, when an operating frequency, at which the across-ends voltage VLa of the discharge lamp La becomes the ignition voltage VS through the main inverter INV1, is denoted by f3, the filament inverter causes the operating frequency f4 for preheating of the filaments F1 and F2 to be set higher than the operating frequency f3 (f3<f4).

Therefore, when the main inverter INV1 and filament inverter INV2 are operated at the same operating frequency, the main inverter INV1 and filament inverter INV2 must operate at an operating frequency of the operating frequency f4 or more in the preheating mode. When the discharge lamp La is sufficiently preheated without ignition thereof and after ignited, is operated at an operating frequency of the operating frequency f1 or less; it becomes possible to operate the lamp in the dimming mode with the suitable filament current IF.

Explanation will next be made as to the electronic ballast for discharge lamps of the present invention in connection with specific embodiments.

Figure 4:
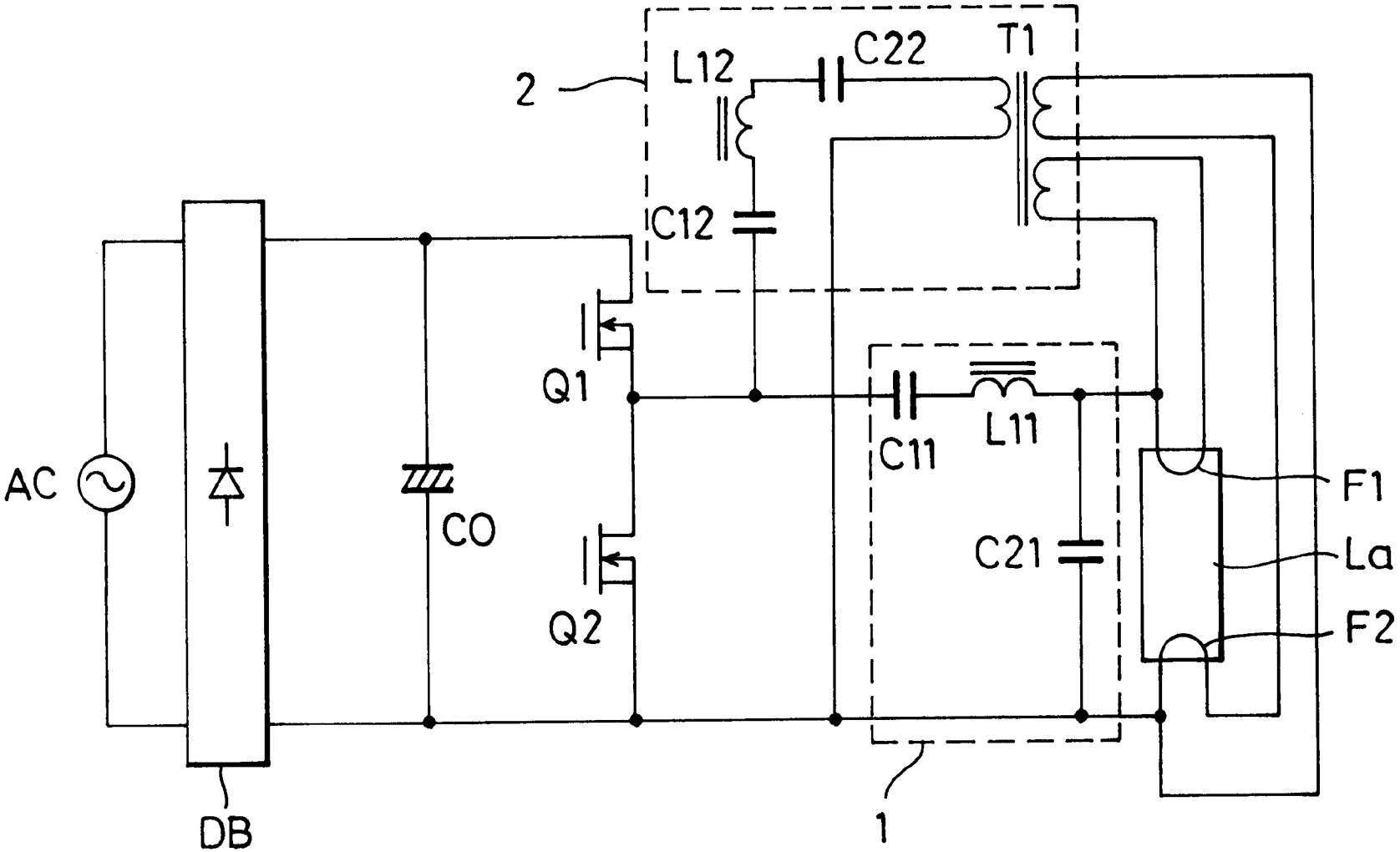
FIG. 4 is a circuit diagram of an electronic ballast for discharge lamps in accordance with an embodiment 1 of the present invention.

(Embodiment 1):

In the present embodiment shown in FIG. 4, the main resonance circuit 1 and filament resonance circuit 2 share a power supply and switching elements Q1 and Q2. As individual non-shared elements, inductors L11 and L12 and capacitors C21 and C22 form a resonance circuit together with capacitors C11 and C12 for blocking D.C. components and the discharge lamp La. The filament resonance circuit 2 includes a transformer T1 having two secondary windings.

More in detail, a D.C. power as the common power supply of the main resonance circuit 1 and filament resonance circuit 2 is obtained by full-wave rectifying an A.C. power of an A.C. power source AC as a commercial power source through a rectification circuit DB of a diode bridge and by smoothing an output of the rectification circuit DB through a smoothing capacitor CO.

The main resonance circuit 1 includes a series circuit of a pair of switching elements Q1 and Q2 of MOS FETs connected in parallel to the smoothing capacitor C0, one Q2 of the switching elements Q1 and Q2 being connected in parallel to a series circuit of the D.C. blocking capacitor C11, inductor L11 and capacitor C21. Also connected to the capacitor C21 in parallel is the discharge lamp La. Although it is assumed in the present embodiment to use such a slim lamp as T5 or TL-5 manufactured by Phillips Ltd. as the discharge lamp La, the technique of the present embodiment may be applied to even another types of discharge lamps.

Further, the filament resonance circuit 2 shares the switching elements Q1 and Q2 together with the main resonance circuit 1, one Q2 of the switching elements Q1 and Q2 being connected in parallel to a series circuit of the D.C. blocking capacitor C12, inductor L12, capacitor C22 and a primary winding of the transformer T1. The transformer T1 also has the secondary windings which are connected to the filaments F1 and F2 respectively. Both the switching elements Q1 and Q2 are alternately turned ON and OFF at a high frequency in such a manner that the switching elements will not be turned ON at the same time under control of a general control circuit (not shown). Accordingly, when charges accumulated in the capacitors C11 and C12 during an ON period of the switching element Q1 are discharged during an OFF period of the switching element Q2, an alternating high frequency power can be provided to the discharge lamp La.

Meanwhile, the capacitors C11 and C12 have capacitances larger by an order of magnitude than those of the capacitors C21 and C22 and thus, the capacitances can be neglected. Therefore, the main resonance circuit 1 comprises, as main components, the inductor L11, capacitor C21 and discharge lamp La; whereas, the filament resonance circuit 2 comprises, as main components, the inductor L12, capacitor C22, transformer T1 and filaments F1 and F2 of the discharge lamp La. The both resonance circuits have mutually independent characteristics and the resonance frequencies of the both resonance circuits are set to such characteristics as shown in FIGS. 2 and 3. The operating frequency of the switching elements Q1 and Q2 is controlled to be within a range explained in the basic arrangement.

In the present embodiment, since the transformer T1 is employed, use of a leakage transformer as the transformer T1 enables the transformer T1 to have a function of limiting a current of the inductor L12. In other words, since the function of the inductor L12 can be done by the transformer T1, the number of necessary parts can be reduced. The switching elements Q1 and Q2 are not limited to the MOS FETs but may be replaced by such switching elements capable of controlling their ON and OFF operation as bipolar transistors.

Figure 5:
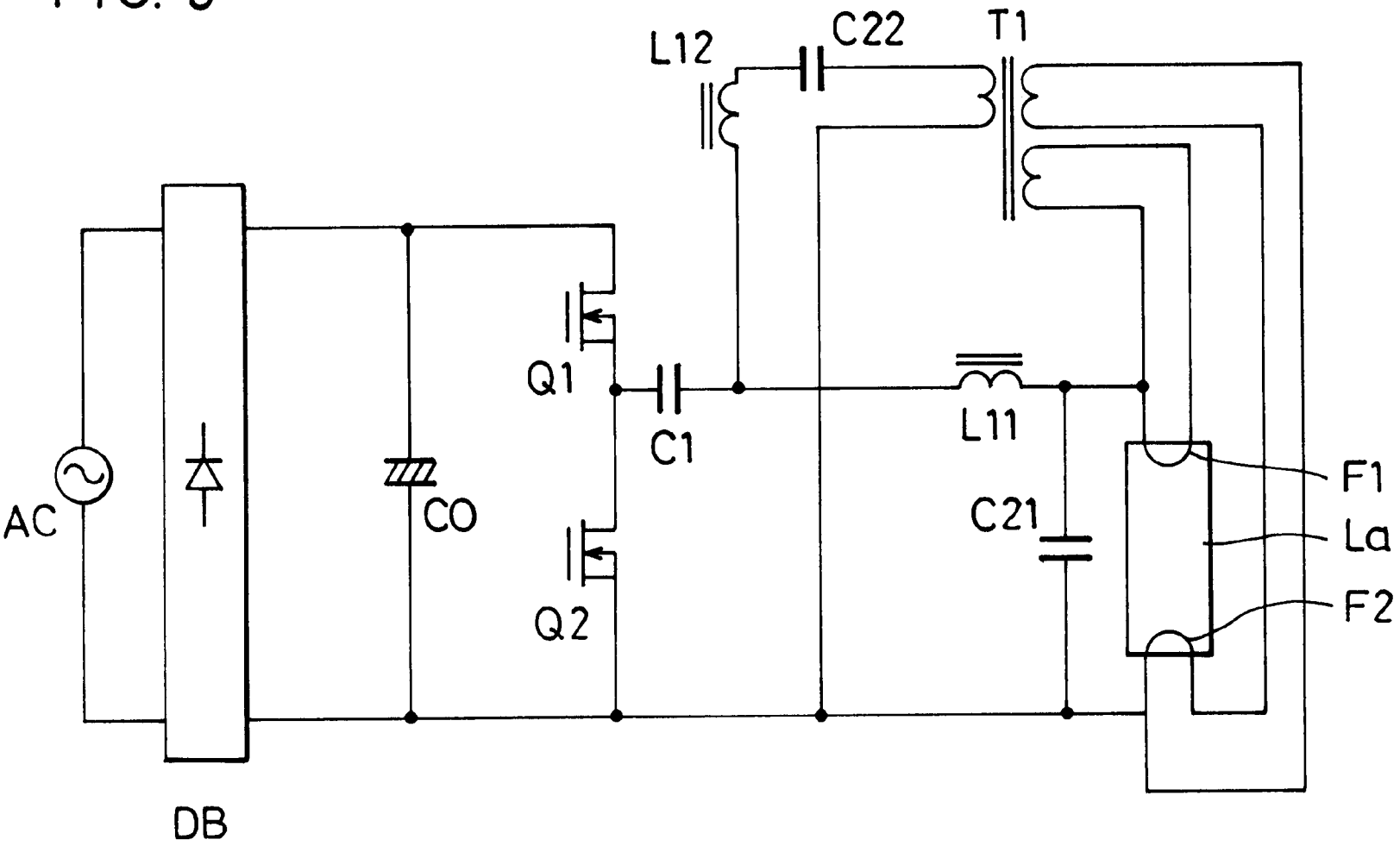
FIG. 5 is a circuit diagram of an electronic ballast for discharge lamps in accordance with an embodiment 2 of the present invention.

(Embodiment 2):

In the present embodiment, as shown in FIG. 5, the DC blocking capacitors C11 and C12 are replaced by a single capacitor C11. Since capacitances of the capacitors C11 and C12 are sufficiently (by an order of magnitude) larger than those of the capacitors C21 and C22, the above replacement to the single capacitor enable reduction of the number of necessary parts and also enables remarkable reduction of costs when compared to common use of other part. Other arrangement and operation are substantially the same as those of the embodiment 1.

Figure 6:
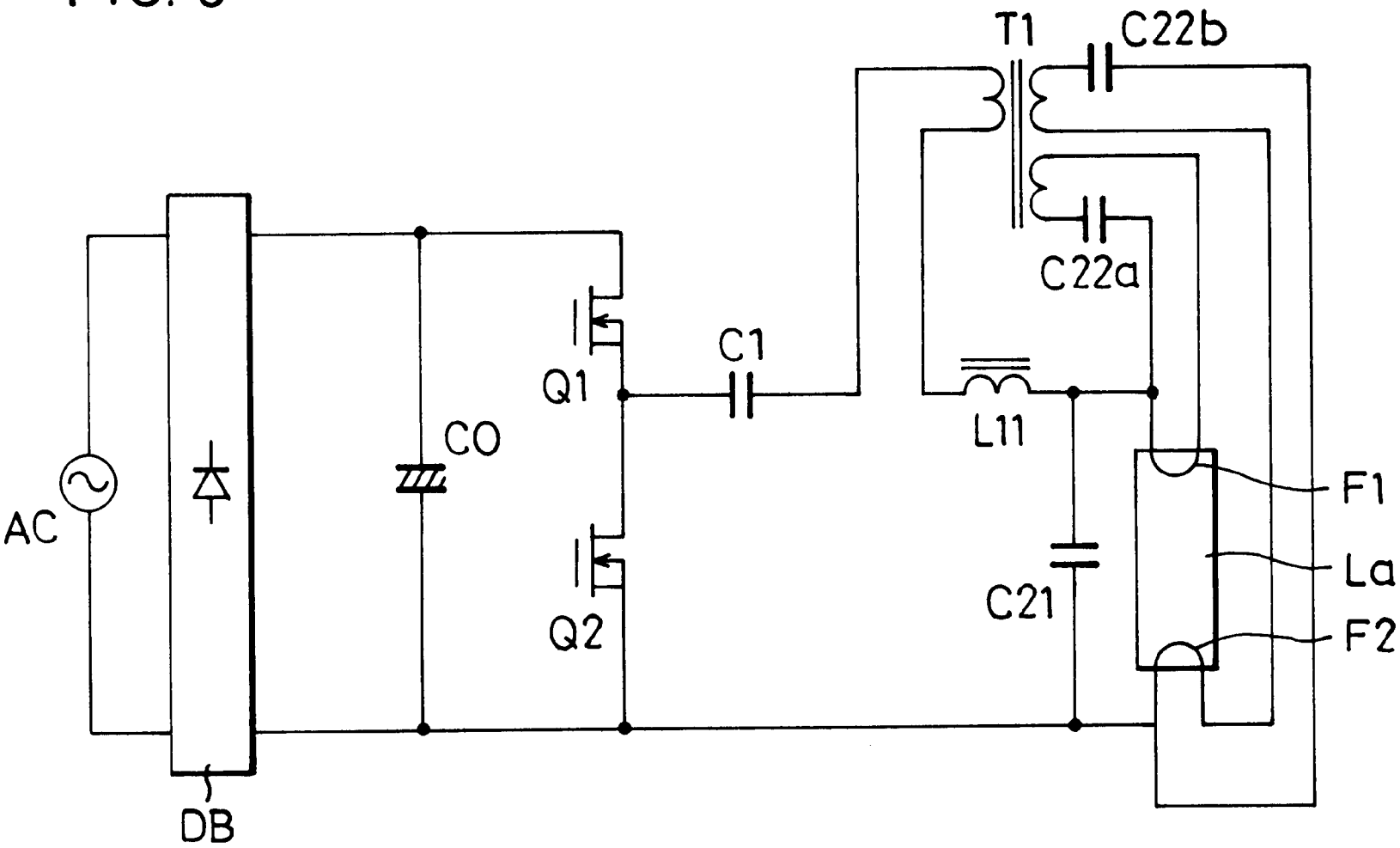
FIG. 6 a circuit diagram of an electronic ballast for discharge lamps in accordance with an embodiment 3 of the present invention.

(Embodiment 3):

In the present embodiment, as shown in FIG. 6, the primary winding of the transformer T1 is inserted between the DC blocking capacitor C1 and the inductor L11. Since the transformer T1 comprises a leakage transformer, the inductor L12 is omitted. Further used as capacitors forming the filament resonance circuit are capacitors C22*a* and C22*b* which are inserted between the two secondary windings of the transformer T1 and the filaments F1 and F2 respectively.

Figure 7:
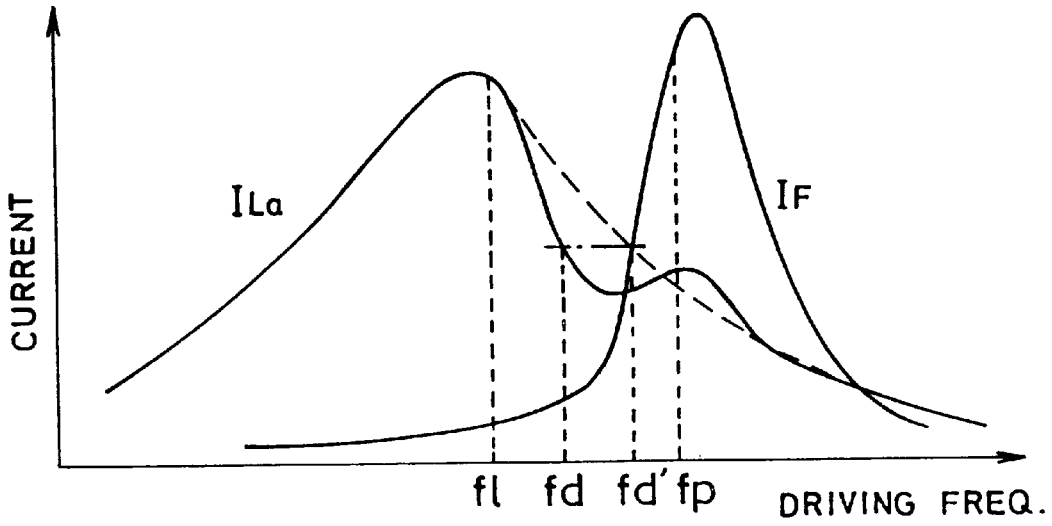
FIG. 7 is a frequency characteristic diagram of the embodiment 3 of FIG. 6.

Constants in the present embodiment 3 are set so as to have such a relationship as shown in FIG. 7. More specifically, a preheating frequency fp (corresponding to the operating frequency f1 of the basic arrangement) is set to be higher than a dimming frequency fd (corresponding to the operating frequency f4 of the basic arrangement) and to be able to secure a preheating current. The capacitors C22*a* and C22*b* are set so that the filament current IF has its peak value at a frequency slightly higher than the preheating frequency fp.

In the present embodiment, because an output of the filament resonance circuit 2 is extracted from a part of the main resonance circuit 1, the resonance characteristic of the main resonance circuit 1 is influenced by the filament resonance circuit 2. Thus, as shown by solid lines in FIG. 7, an output current of the main resonance circuit 1 also has a peak value in the vicinity of the peak of the filament current IF, and output currents of the main resonance circuit 1 at both ends of the peak point are lower than those in the absence (shown by a dotted line in FIG. 7) of the filament resonance circuit 2.

When the operating frequency is increased from the operating frequency f1 of the normal operating mode, this causes the lamp current to abruptly drop when compared to the case of absence of the filament resonance circuit 2. That is, the dimming frequency fd is lower than a dimming frequency fd' in the absence of the filament resonance circuit 2. As a result, a difference between the preheating frequency fp and dimming frequency fd can be made large, so that the filament current IF in the dimming mode can be made easily small.

As has been explained above, since the filament current IF in the dimming mode can be made easily smaller than that in the preheating mode in the present embodiment 3, the present embodiment can be easily applied even to the discharge lamp La of a slim tube. Other arrangement and operation of the present embodiment are substantially the same as those of the embodiment 1.

Figure 8:
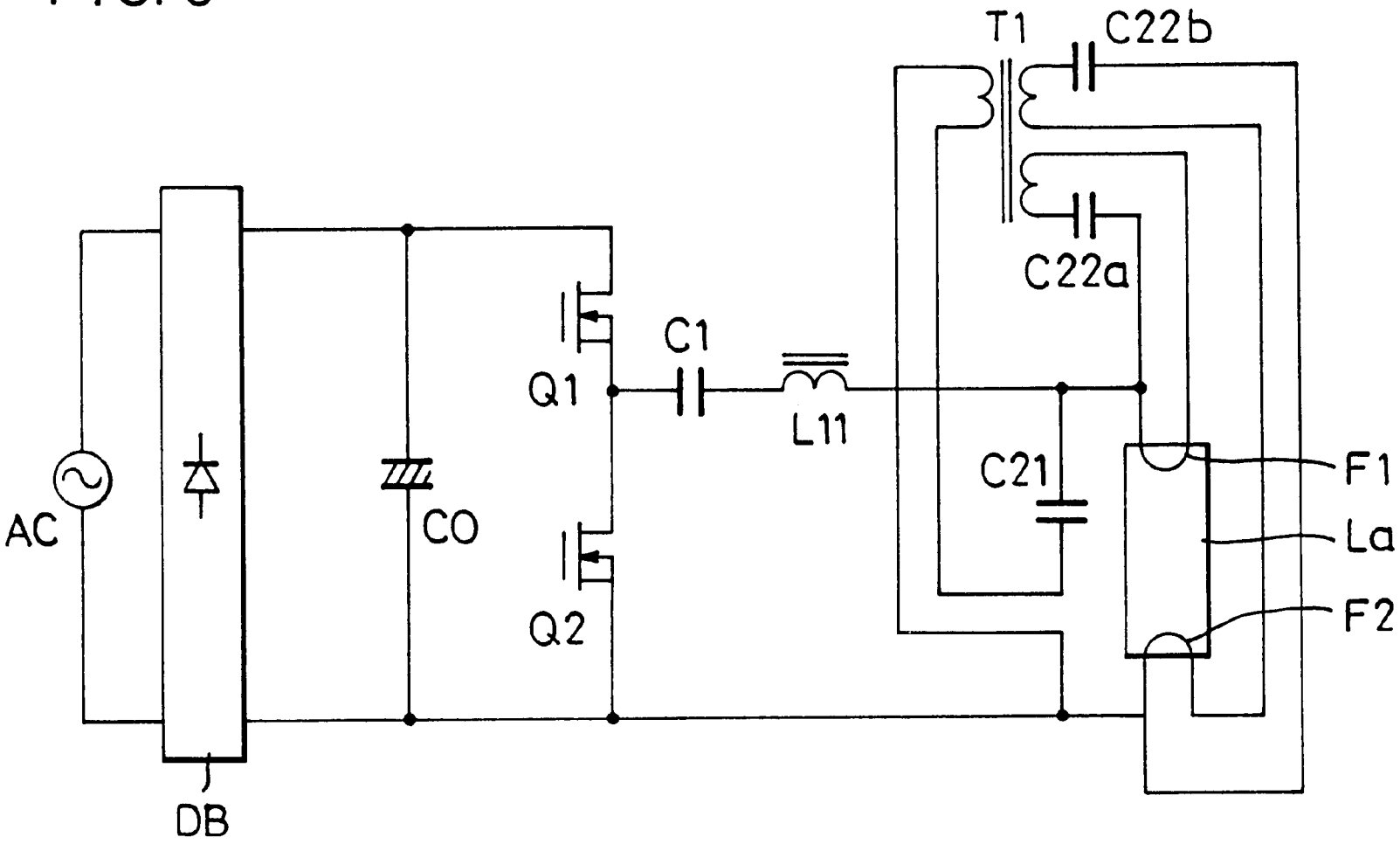
FIG. 8 a circuit diagram of an electronic ballast for discharge lamps in accordance with an embodiment 4 of the present invention.

(Embodiment 4):

In the present embodiment 4, as shown in FIG. 8, the primary winding of the transformer T1 is connected in series with the capacitor C21. As in the embodiment 3, an output of the filament resonance circuit 2 is extracted from a part of the main resonance circuit 1. That is, the present embodiment has substantially the same arrangement as the embodiment 3, except that the output extraction position is different from that in the embodiment 3. Even how to set constants of the capacitors C22*a* and C22*b* is carried out under the same conditions as in the embodiment 3.

Figure 9:
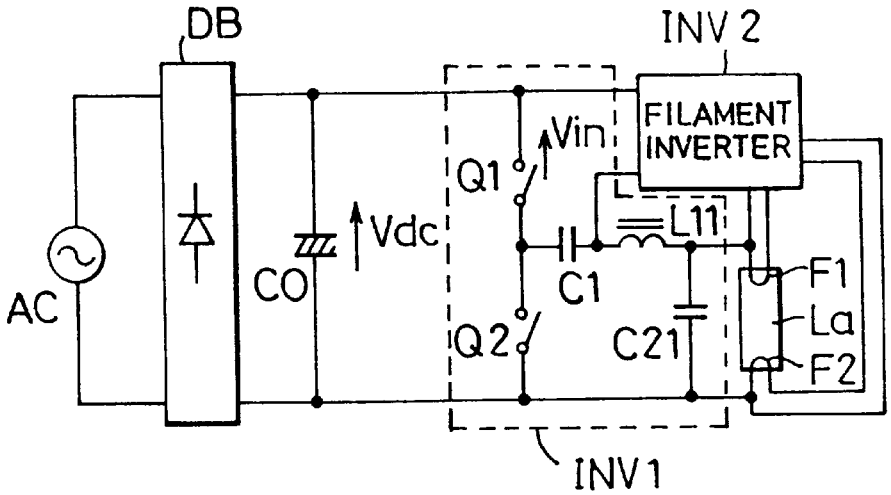
FIG. 9 is a circuit diagram of an electronic ballast for discharge lamps in accordance with an embodiment 5 of the present invention.

(Embodiment 5):

In the present invention, as shown in FIG. 9, a power of the filament inverter INV2 is extracted from both ends of a series circuit of the switching element Q1 and DC blocking capacitor C1 of the main inverter INV1.

Figure 10:
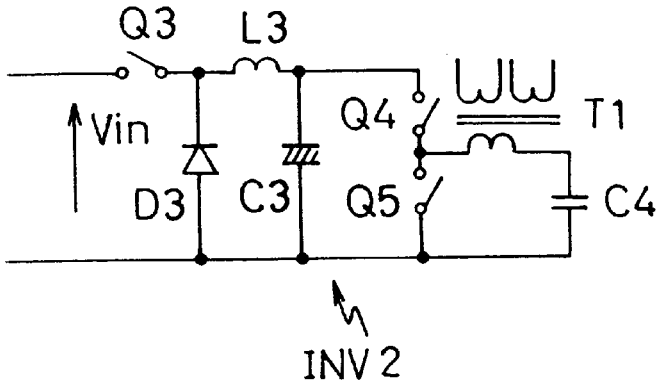
FIG. 10 is a circuit diagram of another modification of the embodiment 5 of FIG. 9.

The filament inverter INV2, as shown in FIG. 10, includes a voltage depressing chopper part and an inverter circuit of a half bridge type operated by the capacitor C3 as its power supply. In the voltage depressing chopper part, a series circuit of a switching element Q3, an inductor L3 and a capacitor C3 is connected to the series circuit of the switching element Q1 and capacitor C1; a diode D3 is connected at its cathode to a junction point of the switching element Q3 and inductor L3 and at its anode to a negative side of the capacitor C3. In the inverter circuit, a series circuit of a pair of switching elements Q4 and Q5 is connected to both ends of the capacitor C3, and a series circuit of the primary winding of the transformer T1 and a DC blocking capacitor C4 is connected in parallel to one Q5 of the switching elements Q4 and Q5.

In this case, when the switching element Q3 is turned ON and OFF at a high frequency by a control circuit (not shown), an input voltage is decreased to charge the capacitor C3. Turning ON and OFF of the switching elements Q4 and Q5 causes a DC voltage across the capacitor C3 to be converted to a high frequency power. Accordingly, even the switching elements Q4 and Q5 are turned ON and OFF by the control circuit.

Figure 11:
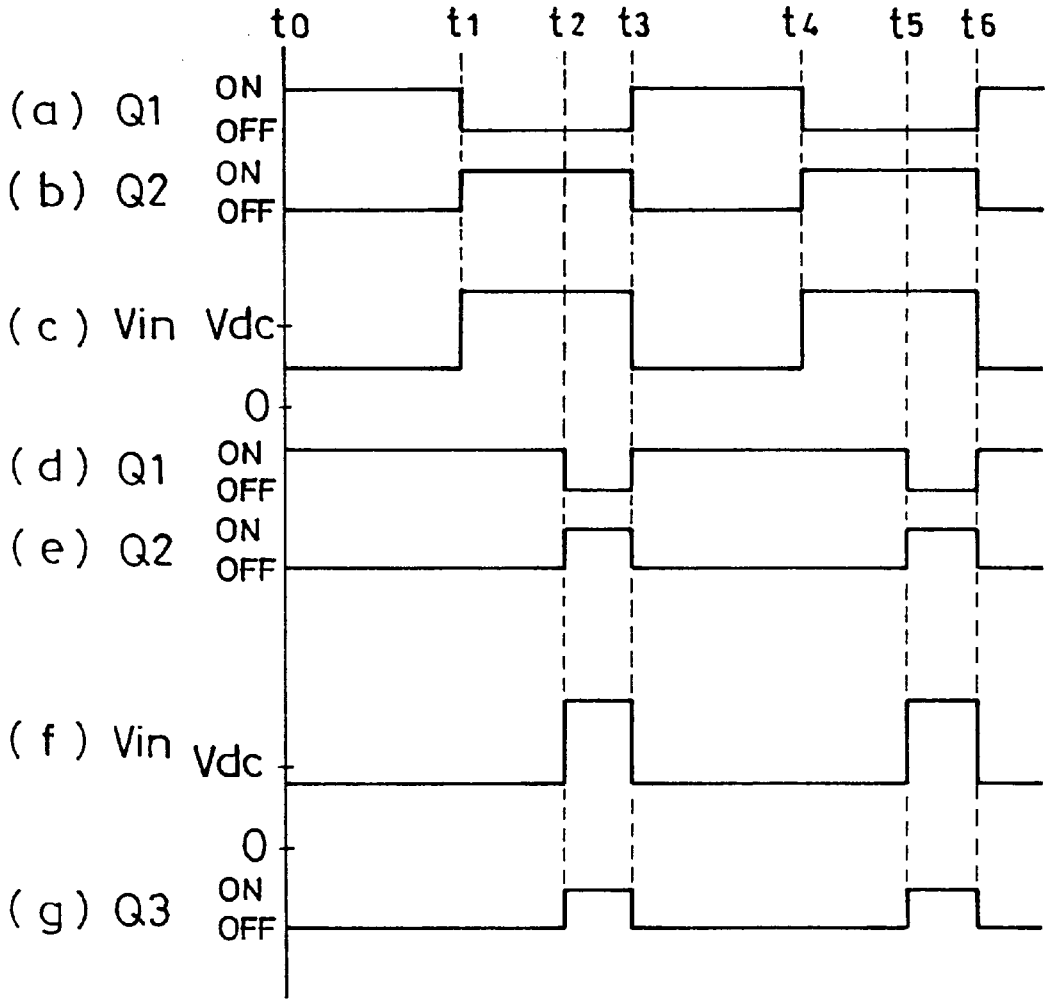
FIG. 11 (a–g) is a timing chart for explaining the operation of the embodiment 5 of FIG. 9.

Explanation will be made more in detail. In the present embodiment 3, for the purpose of changing the power to be supplied to the discharge lamp La, ON duty cycles of the switching elements Q1 and Q2 is changed without changing the operating frequency thereof. That is, as shown in FIG. 11, (*a*) to (*e*), ON and OFF periods of the switching elements Q1 and Q2 are changed, for example, from a time ratio between a period t0–t1 and a period t1–t3 to a time ratio between a period t0–t2 and a period t2–t3. Thus, when the ON period of the switching element Q1 is set to be longer than the ON period of the switching element Q2 as such a relationship as shown in FIG. 11, (*d*) or (*e*), the across-ends voltage across the capacitor C1 becomes high, a voltage applied to the resonance circuit of the inductor L11 and capacitor C21 during the ON period of the switching element Q1 drops, and thus the power to be supplied to the discharge lamp La is eventually reduced. Further, the voltage supplied to the above resonance circuit during the ON period of the switching element Q2 becomes high, but its high period is short and therefore the power to be supplied to the discharge lamp La becomes small.

The voltage Vin across the series circuit of the switching element Q1 and capacitor C1, on the other hand, is used as the power supply of the filament inverter INV2, so that the input voltage Vin to the filament inverter INV2 has such a relationship as shown by FIG. 11, (*c*) or (*f*). More specifically, during the period of t2–t3, when the energy supplied to the discharge lamp La is decreased, the input voltage Vin to the filament inverter INV2 rises. In this case, when the switching element Q3 is turned ON during the period of t2–t3 as in FIG. 11, (*g*), the voltage across the capacitor C3 rises as the power supplied to the discharge lamp La is decreased. As a result, it is possible to increase the preheating power to be supplied to the filaments F1 and F2 as the power supplied to the discharge lamp La decreases. Through such action, in the dimming mode, the filaments F1 and F2 can be sufficiently preheated to put the lamp in a easy discharging state, whereby the dimming can be stably achieved.

Figure 12:
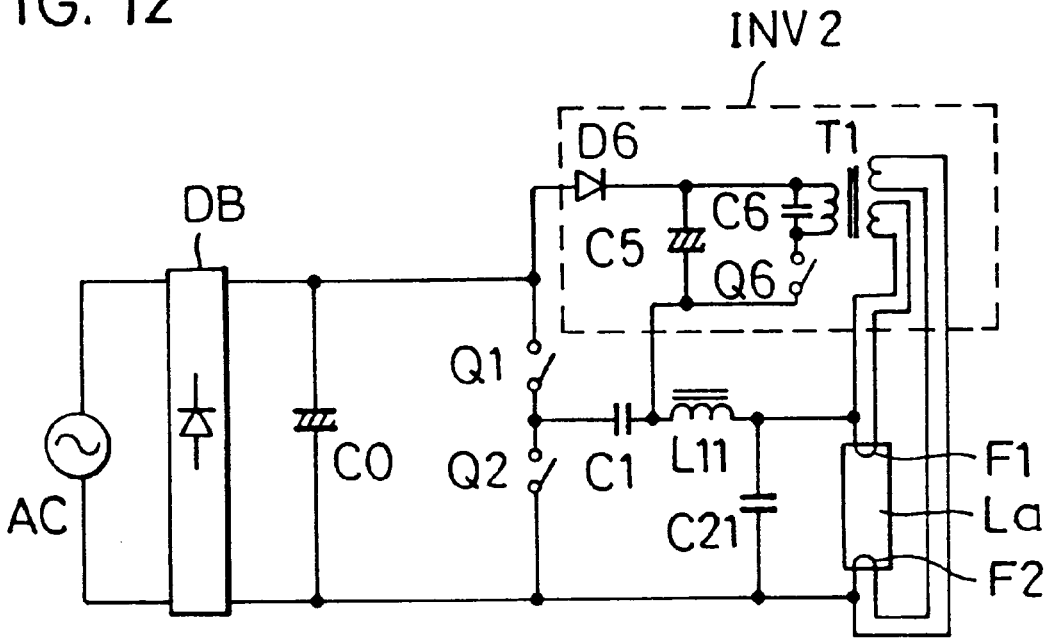
FIG. 12 is a circuit diagram of an electronic ballast for discharge lamps in accordance with an embodiment 6 of the present invention.

(Embodiment 6):

In the present embodiment 6, as shown in FIG. 12, the structure of the filament inverter INV2 in the embodiment 5 is modified, that is, one solid-state inverter is employed. More specifically, a series circuit of a diode D6 and the capacitor C5 is connected across a series circuit of the switching element Q1 and capacitor C1, a series circuit of the primary winding of the transformer T1 and a switching element Q6 is connected to the capacitor C5, and a resonating capacitor C6 is connected in parallel to the primary winding of the transformer T1.

Other arrangement and operation are substantially the same as those of the embodiment 5. That is, the power to be supplied to the discharge lamp La is controlled by changing the ON duty cycles of the switching elements Q1 and Q2, so that, as the power to be supplied to the discharge lamp La is decreased, the power supplied to the filament inverter INV2 rises, which results in that the preheating power to be supplied to the filaments F1 and F2 increases, thus realizing the stable operating of the lamp even in the dimming mode.

Figure 13:
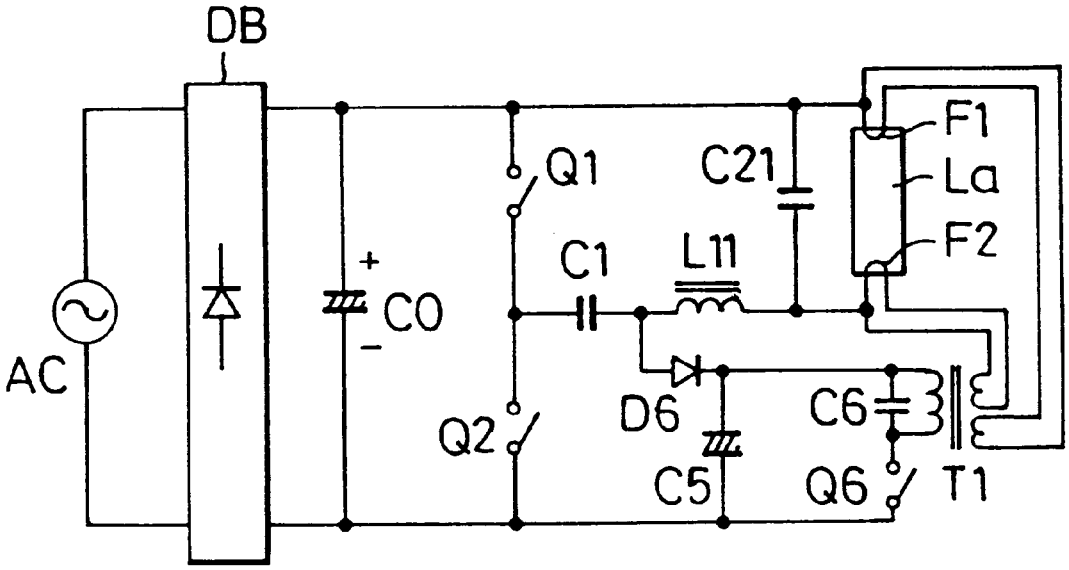
FIG. 13 is a circuit diagram of an electronic ballast for discharge lamps in accordance with an embodiment 7 of the present invention.

(Embodiment 7):

In the foregoing embodiment 6, the power of the filament inverter INV2 has been extracted from the both ends of the series circuit of the positive-side switching element Q1 and capacitor C1. In the present embodiment, however, as shown in FIG. 13, the power is extracted from the both ends of a series circuit of the negative-side switching element Q2 and capacitor C1. Further, a series circuit of the discharge lamp La, inductor L11, capacitor C1 and capacitor C21 is connected in parallel not to the switching element Q2 but to the switching element Q1. In this way, the present embodiment corresponds to the embodiment 6 but the positive-side arrangement is exchanged with the negative-side arrangement.

The basic operation of the present embodiment is substantially the same as that of the embodiment 6, so that, a change in the ON duty cycles of the switching elements Q1 and Q2 causes a change of the voltage across the capacitor C1, thereby changing the power to be supplied to the discharge lamp La. In the dimming mode, when the power to be supplied to the discharge lamp La is decreased, the voltage across the capacitor C5 of the filament inverter INV2 rises, with the result that the preheating power to be supplied to the filaments F1 and F2 is increased. Thus, even with this arrangement, stable operating can be realized in the dimming mode. In the present embodiment, further, the switching elements Q2 and Q6 have the same reference potential and thus a level shift circuit for changing the reference potential is unnecessary to provide in the control circuit for driving the switching element Q6, whereby the structure of the control circuit can be made simple. Other arrangement and operation are substantially the same as those of the embodiment 6.

Figure 14:
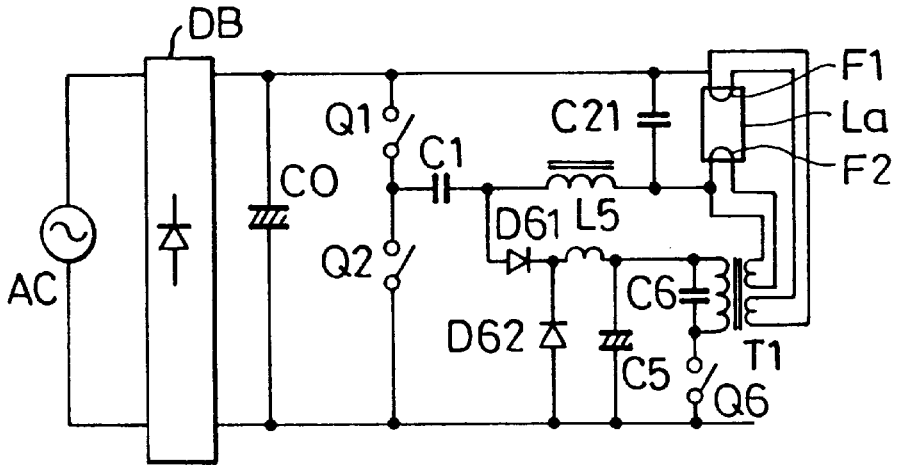
FIG. 14 is a circuit diagram of an electronic ballast for discharge lamps in accordance with an embodiment 8 of the present invention.

(Embodiment 8):

The charging operation to the capacitor C5 has been carried out by the rectangular voltage in the embodiment 7. In the present embodiment, however, as shown in FIG. 14, the charging current to the capacitor C5 is made smooth by providing an inductor between a diode D61 and and the capacitor C5. In this case, the diode D62 acts as a freewheel diode for causing a current flowing through the indicator L5 to continuously flow at the moment the diode D61 is turned off. Employment of such an arrangement enables a voltage across the capacitor C5 to less vary. Further, since the full-wave rectification enables a high power utilization efficiency to become high and the charging voltage to become smoothed; a power conversion efficiency becomes high. Other arrangement and operation are substantially the same as those of the embodiment 7.

(Embodiment 9):

The present embodiment has the same circuit configuration as the embodiment 1, but the control manner of the switching elements Q1 and Q2 is modified. That is, only the operating frequency is changed in the preheating mode and in the normal operating mode as in the embodiment 1, whereas not the operating frequency but the ON duty cycle is changed in the dimming mode.

In the preheating mode, ignition mode and normal operating mode, only the operating frequency is changed to control the power to be supplied to the discharge lamp La and the filament current IF, with 50% of the ON duty cycle (which becomes actually somewhat smaller than 50% because a dead time for simultaneous turning OFF of the both switching elements Q1 and Q2 for the purpose of preventing the simultaneous turning ON of the switching elements Q1 and Q2) of the switching elements Q1 and Q2.

In the dimming mode, meanwhile, the ON duty cycles of the switching elements Q1 and Q2 is changed. For example, the ON duty cycles of the both switching elements Q1 and Q2 are set unequal, e.g., to be 30% and 70%, 60% and 40%, etc. When the ON duty cycles are set to be 50% and 50%, the voltage across the capacitor C11 becomes nearly half of the voltage across the capacitor C0. Since the ON duty cycles are set unequal as mentioned above, however, the voltage across the capacitor C11 rises, which results in the power to be supplied to the discharge lamp La is varied or reduced for the dimming.

Figure 15:
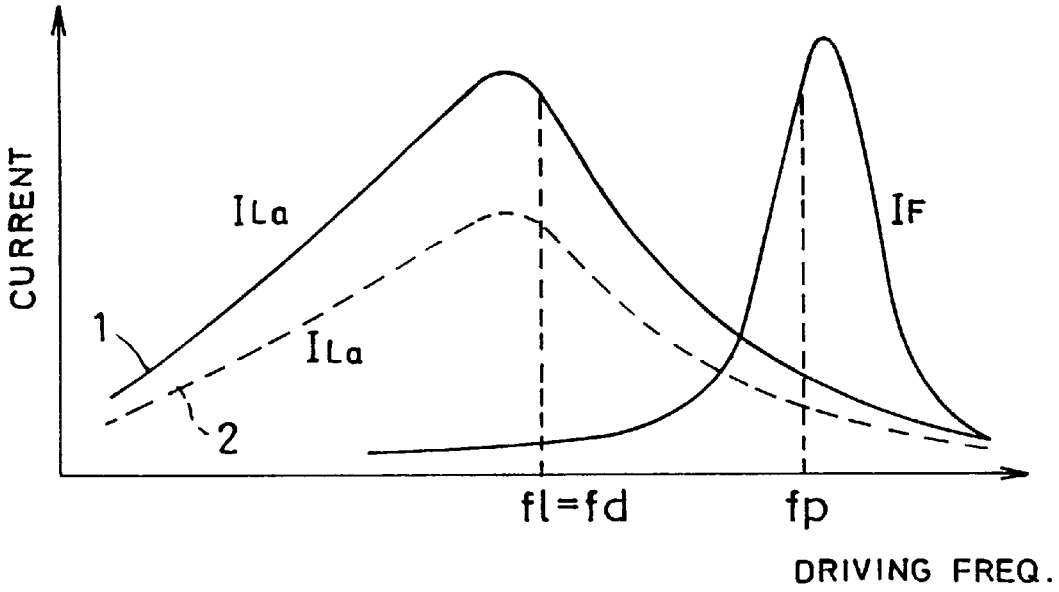
FIG. 15 is a frequency characteristic diagram of an embodiment 9 of the present invention.

In the present embodiment, the operating frequency f1 in the normal operating mode is equal to the dimming frequency fd, so that the conditions of the filament current IF in the preheating mode and in the dimming mode can be easily satisfied in the normal operating mode with the basic arrangement while eliminating the need for increasing the filament current IF in the dimming mode. That is, as shown in FIG. 15, an operating frequency-current characteristic (shown by a line 1) in the normal operating mode is shifted to an operating frequency-current characteristic (shown by a dotted line 2) in the normal operating mode in a direction of pulling down the lamp current ILa, whereby dimming can be realized only by changing the ON duty cycles with the same frequency. This results in that a difference between the preheating frequency fp and dimming frequency fd becomes large so that the upper limit of the filament current IF in the dimming mode rather than the lower limit of the filament current IF in the preheating mode can be sufficiently pulled down.

Other arrangement and operation are substantially the same as those of the embodiment 1.

Figure 16:
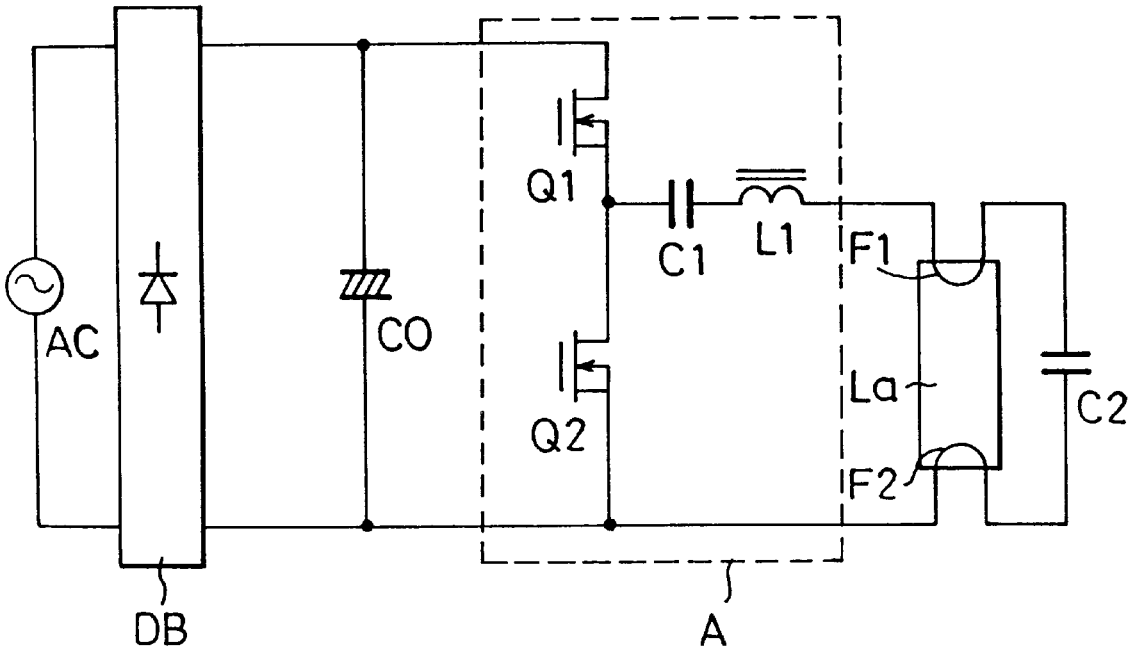
FIG. 16 is a circuit diagram of the embodiment of FIG. 15 of the present invention.

Even in such a capacitor preheating system as shown in FIG. 16, when the duty cycles of the switching elements Q1 and Q2 are controlled, the dimming frequency fd can be set at a level equal to the operating frequency f1 or somewhat higher therethan, so that a difference between the dimming frequency fd and preheating frequency fp can be made relatively large.

Figure 17:
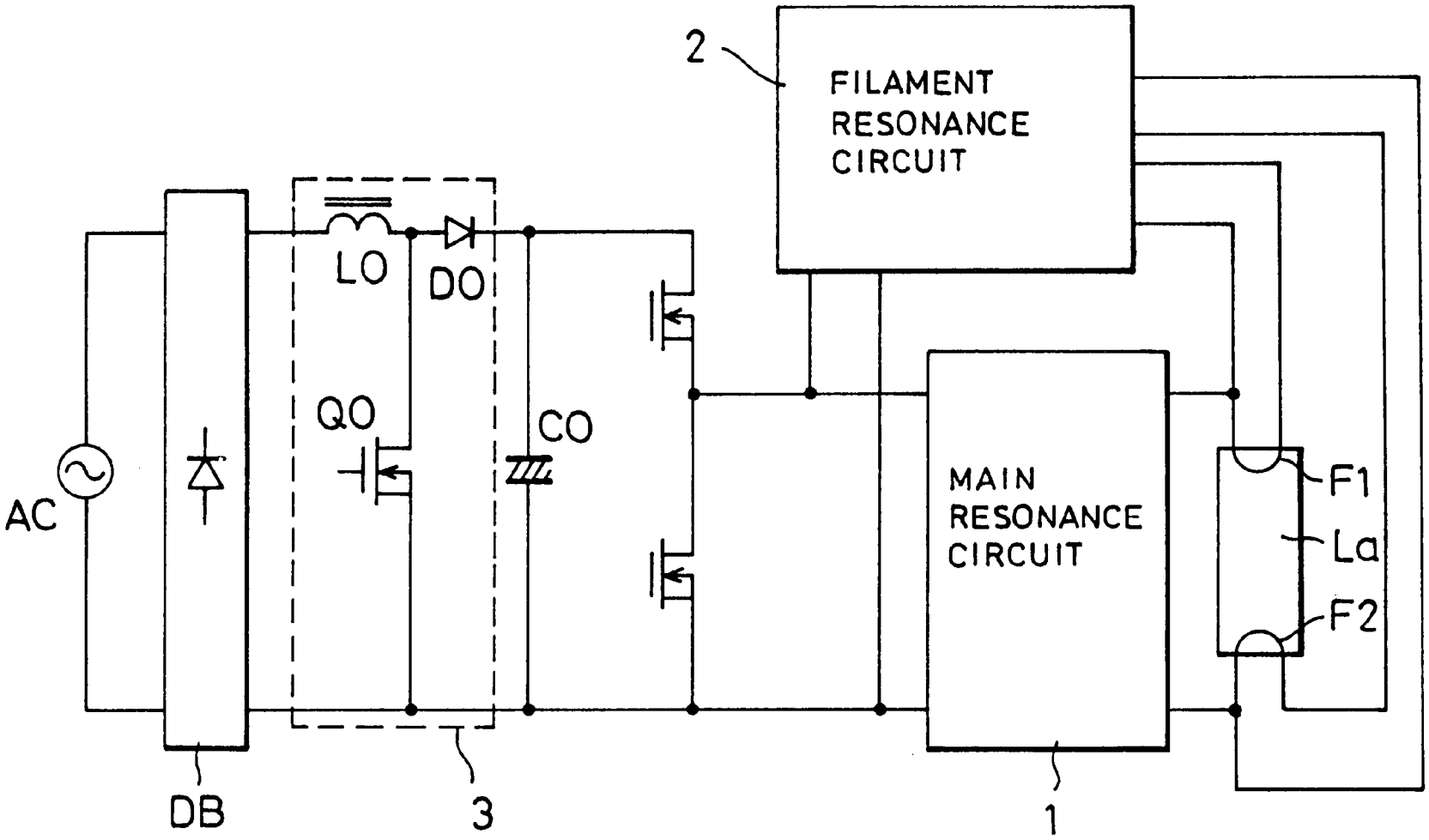
FIG. 17 is a circuit diagram of an electronic ballast for discharge lamps in accordance with an embodiment 10 of the present invention.

(Embodiment 10):

In the present embodiment, as shown in FIG. 17, a voltage regulation circuit 3 is provided between the smoothing capacitor C0 and rectification circuit DB which act as the power supplies of the main resonance circuit 1 and filament resonance circuit 2. In the illustrated embodiment, a booting chopper circuit is uses as the voltage regulation circuit 3. More in detail, a series circuit of an inductor L0 and a switching element Q0 is connected between output terminals of the rectification circuit DB, and the smoothing capacitor C0 is connected across the switching element Q0 via a diode D0. The switching element Q0 is turned ON and OFF at a high frequency under control of a control circuit (not shown) to change the ON period based on PWM control and to thereby adjust a voltage across the smoothing capacitor C0.

Accordingly, when it is required to set lower the voltage across the discharge lamp La in the preheating mode, the ON duty cycle of the switching element Q0 is made small to thereby set low the voltage across the smoothing capacitor C0. When it is required to set high the voltage across the discharge lamp La as in the ignition mode, the ON duty cycle of the switching element Q0 is made large to set high the voltage across the smoothing capacitor C0. In this connection, when a means is separately provided for detecting a dismounting of the discharge lamp La or the end of the life of the discharge lamp La, such control becomes possible as to pull down the output voltage of the voltage regulation circuit 3, whereby the voltage between the electrodes when the discharge lamp La is disconnected can be pulled down to avoid an electric shock or to reduce a stress imposed on the circuit constituent elements caused by excessive energy at the time of a light load.

The structures and operations of the main resonance circuit 1 and filament resonance circuit 2 are substantially the same as those in the embodiment 1, and the difference between the preheating frequency fp and the operating frequency f1 or dimming frequency fd can be made sufficiently large. In other words, the filament current IF in the normal operating mode or in the dimming mode can be made small.

As has been mentioned above, the provision of the voltage regulation circuit 3 enables the output control of the main resonance circuit 1 to be much easier than in the arrangement of the embodiment 1 and also enables design of the frequency characteristics of the main resonance circuit 1 and filament resonance circuit 2 to be conducted in a wide range. In addition, when the aforementioned chopper circuit is employed as the voltage regulation circuit 3, the input current can continuously flow from the A.C. power source AC to the rectification circuit DB in a high frequency manner. Therefore, only by inserting a simple high-frequency blocking filter between the A.C. power source AC and rectification circuit DB, the waveform of the input current can be made continuous. In other words, a distortion in the input current can be minimized.

Figure 18:
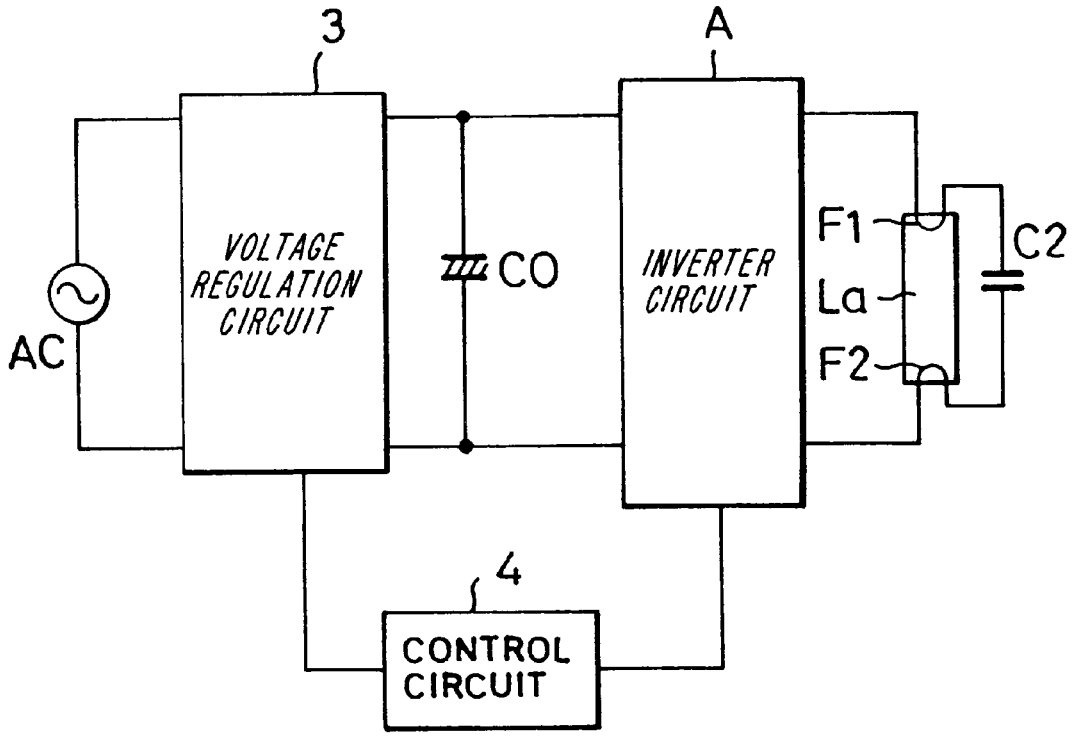
FIG. 18 is a diagram for explaining the embodiment 10 of FIG. 17.

Meanwhile, when the voltage regulation circuit 3 is provided as in the present embodiment, the operating frequencies of the switching elements are varied in an inverter circuit A having an arrangement shown in FIG. 16 and the input voltage to the inverter circuit A is adjusted, so that the conditions both in the preheating mode and in the dimming mode can be satisfied. That is, as shown in FIG. 18, the voltage regulation circuit 3 is provided to change the voltage across the smoothing capacitor CO according to the operational state of the discharge lamp La.

More specifically, the operating frequency of the inverter circuit A in the preheating mode is set to be higher than that in the dimming mode and the voltage across the smoothing capacitor C0 is set high so as to increase a current flowing through the capacitor C2, i.e., the filament current IF. The operating frequency of the inverter circuit A in the dimming mode is set to be lower than that in the preheating mode and correspondingly the voltage across the capacitor C0 is set low so as to decrease the filament current IF flowing through the capacitor C2. In short, the operating frequency of the inverter circuit A is controllably varied and the input voltage of the inverter circuit A is varied to thereby provide a sufficient difference between the filament current IF in the preheating mode and that in the dimming mode. Such control of the operating frequency and the voltage across the capacitor C0 is carried out by a control circuit 4 which judges the preheating mode, normal operating mode or dimming mode on the basis of the operational state of the inverter circuit A. When the voltage regulation circuit 3 comprises a chopper circuit as mentioned above, its input power factor can be improved. That is, the voltage regulation circuit 3 can contribute not only to adjustment of the voltage across the capacitor CO but also to improvement of the power factor.

Figure 19:
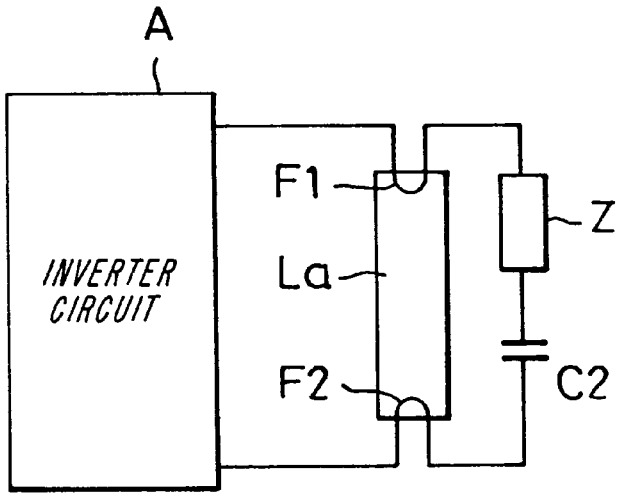
FIG. 19 is a circuit diagram of an electronic ballast for discharge lamps in accordance with an embodiment 11 of the present invention.

(Embodiment 11):

In the present embodiment, as shown in FIG. 19, a series circuit of the capacitor C2 and a variable impedance Z is connected between ones of the filaments F1 and F2 of the discharge lamp La not connected to the power supply, and the variable impedance Z is provided to control the voltage across the lamp. The variable impedance Z may employ such a circuit configuration as shown in one of FIG. 20*a* to 20*d*. That is, in FIG. 20*a*, a secondary winding of a transformer T2 is connected in parallel to a capacitor C7; in FIG. 20*b*, a series circuit of the secondary winding of the transformer T2 and a capacitor C8 is connected in parallel to the capacitor C7; in FIG. 20*c*, only the transformer T2 is provided; and in FIG. 20*d*, a parallel circuit of the secondary winding of the transformer T2 and an inductor L7 is connected in parallel to the capacitor C7. With these configurations, when the voltage to be applied to the primary winding of the transformer T2 is controlled, the voltage across the capacitor C7 or the impedance of the secondary winding of the transformer T2 can be controlled.

Figure 21A:
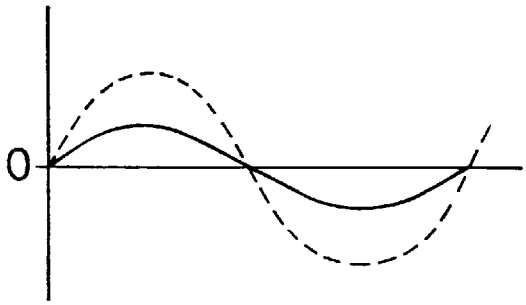
FIGS. 21*a* and 21*b* are diagrams for explaining the operation of the embodiment of FIG. 19 respectively.
Figure 21B:
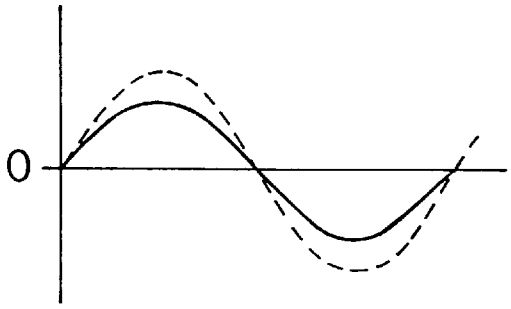

Now the voltage to be applied to the primary winding of the transformer T2 is set to satisfy conditions which follow. That is, the primary-winding application voltage is set so as to increase the preheating power in the dimming mode of the supply power of the discharge lamp La smaller than that of the normal operating mode. Further, as shown in FIG. 21, the waveform (shown by a solid line in FIG. 21) of the voltage across the variable impedance Z is set to coincide in phase with the waveform (shown by a dotted line in FIG. 21) of the output voltage of the inverter circuit A. FIG. 21*a* shows the waveform in the preheating mode, and FIG. 21*b* shows the waveform in the dimming mode. In the preheating mode, the voltage across the variable impedance Z is set to be smaller than the output voltage of the inverter circuit A, so that the current flowing through the series circuit of the variable impedance Z and capacitor c2 can be made relatively large, which results in that the sufficient filament current IF can be supplied to the filaments F1 and F2. In the dimming mode, on the other hand, the voltage across the variable impedance Z is made to be larger than the output voltage of the inverter circuit A, so that the filament current IF can be reduced. Such control enables the conditions of the preheating mode and dimming mode to be satisfied. Other arrangement and operation are substantially the same as those of the foregoing arrangement.

Figure 22:
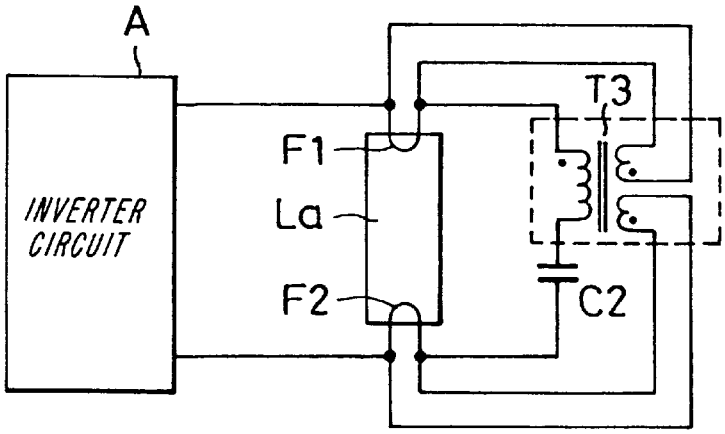
FIG. 22 is a circuit diagram of an electronic ballast for discharge lamps in accordance with an embodiment 12 of the present invention.

(Embodiment 12):

In the present embodiment, as shown in FIG. 22, a series circuit of the capacitor C2 and primary winding of a transformer T3 is connected between ones of the filaments F1 and F2 of the discharge lamp La not connected to the power supply, and two secondary windings of the transformer T3 are connected to the filaments F1 and F2 respectively. The direction of currents flowing through the secondary windings of the transformer T3 and then filaments F1 and F2 are set to coincide with the direction of a current flowing through the primary winding of the transformer T3 and then the filaments F1 and F2.

Thus, since the operating frequency of the inverter circuit A in the dimming mode becomes higher than that in the normal operating mode, the voltage across the primary winding of the transformer T3 in the dimming mode becomes higher than that in the normal operating mode. In other words, when the supply power to the discharge lamp La is small, the preheating power is made large, whereby discharging can be facilitated, which leads to stable operating of the lamp. Other arrangement and operation are substantially the same as those of the embodiment 11.

Figure 23:
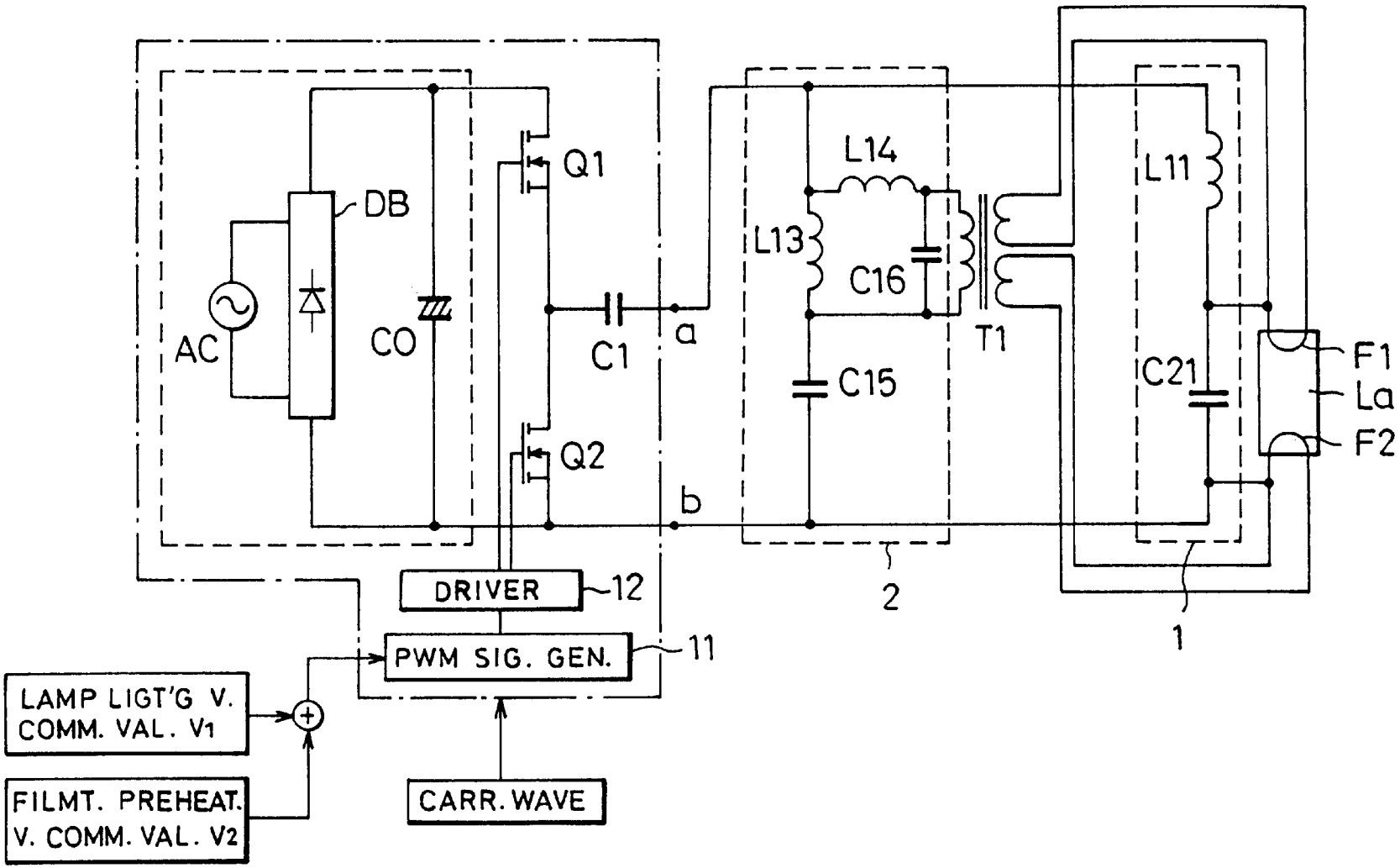
FIG. 23 is a circuit diagram of an electronic ballast for discharge lamps in accordance with an embodiment 13 of the present invention.

(Embodiment 13):

The present embodiment, as shown in FIG. 23, corresponds to the embodiment 2 of FIG. 5 but the filament resonance circuit 2 is modified. In the embodiment 2, the series circuit of the capacitor C1, inductor L12, capacitor C22 and primary winding of the transformer T1 is connected across the switching element Q2. In the present embodiment, on the other hand, a series circuit of the capacitor C1, an inductor L13 and a capacitor C15 is connected across the switching element Q2; a series circuit of an inductor L14 and the primary winding of the transformer T1 is connected across the inductor L13; and a capacitor C16 is connected in parallel to the primary winding of the transformer T1.

When it is regarded in the embodiment 2 that the inverter circuit comprises the switching elements Q1 and Q2 and the DC blocking capacitor C1 and that the main resonance circuit and filament resonace circuit form part of the load circuit, it can be considered that the resonance circuit is a filter inserted in a power supply path to the discharge lamp La. The following explanation will be made from this viewpoint.

Figure 24:
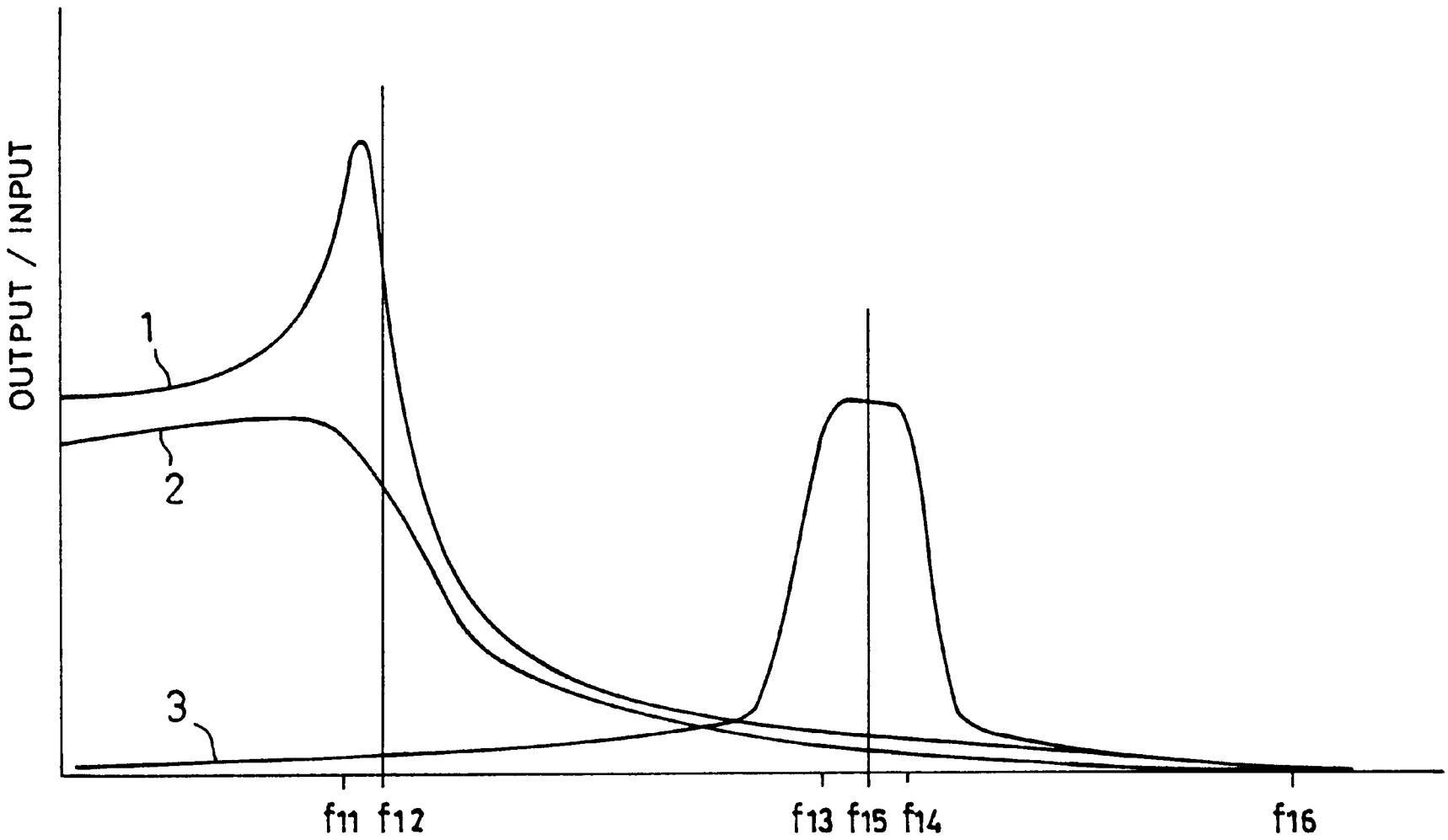
FIG. 24 is a frequency characteristic diagram of the embodiment 13 of FIG. 23.

A filter made up of the inductor L11 and capacitor C21 is set to have a relatively low frequency pass band, exhibits such a frequency characteristic (frequency versus transmittance) as shown by a solid line 1 in FIG. 24 in a non-discharging mode of the discharge lamp La, and shows such a frequency characteristic as shown by a solid line 2 in FIG. 24 in an operating mode of the discharge lamp La. A resonance frequency f11 in the non-discharging mode of the discharge lamp La is expressed by the following equation.

$$f11=1/2\pi(L11\cdot C21)1/2$$

The operating frequency f12 is set to be somewhat higher in the vicinity of the resonance frequency f11.

Meanwhile, a filter comprising the capacitors C15 and C16 and inductors L13 and L14 exhibits such a frequency characteristic as shown by a solid line 3 in FIG. 24. This filter functions as a band pass filter and its cut-off frequencies f13 and f14 are expressed by the following equations respectively.

$$f13=1/2\pi(L13\cdot C15)1/2$$

$$f14=1/2\pi(L14\cdot C16)1/2$$

The preheating frequency f15 is set to lie between the both cut-off frequencies f13 and f14. Since a frequency f16 of a carrier for use in pulse width modulation (PWM) control (to be explained later) is set to be higher than the cut-off frequency f14, this will not influence the preheating of the filaments F1 and F2.

As shown in FIG. 23, the switching elements Q1 and Q2 are turned ON and OFF when receiving from a driver 12 a control signal which is generated by a PWM signal generator 11. In the PWM control, the ON duty cycles of the switching elements Q1 and Q2 are determined by a lamp voltage command value V1 of the frequency f12 and a filament voltage command value V2 of the frequency f15, so that a carrier having the frequency f16 is input to the PWM signal generator 11. A pulse is generated which is turned ON and OFF during periods where the signal value of the carrier is larger and smaller than a threshold value corresponding to an addition of the lamp voltage command value V1 and filament voltage command value V2. Through such operation, the switching elements Q1 and Q2 are turned ON and OFF based on the ON duty cycles according to the addition value of the lamp voltage command value V1 and filament voltage command value V2.

Shown in FIG. 25, in model form, are signals appearing in respective sections. Assuming now that the lamp voltage command value V1 and filament voltage command value V2 are given in such forms as shown in FIGS. 25*b* and 25*c* respectively and that the PWM signal generator 11 generates, based on such a carrier as shown in FIG. 25*a*, the control signal to be supplied to the switching elements Q1 and Q2; then a rectangular-wave output of the frequency f16 with the varying ON duty cycle and the value V1+V2 appears across the series circuit (between points a and b in FIG. 23) of the switching element Q2 and capacitor C1 , as shown in FIG. 25*d*.

Since the voltage to be applied across the discharge lamp La is passed through the inductor L11 and capacitor C21, the voltage proportional to the lamp voltage command value V1 as shown in FIG. 25*e*. Further, since the voltage to be applied to the filaments F1 and F2 is passed through the inductors L12 and L14 and capacitors C15 and C16, the voltage proportional to the filament voltage command value V2 as shown in FIG. 25*f*. Furthermore, since the component of the carrier of the frequency f16 is not included in the frequency pass bands of the both filters, the carrier component will not appear in the application voltage to the discharge lamp La nor in the application voltage of the filaments F1 and F2.

As has been explained in the foregoing, in the present invention, the command values having the different frequencies f12 and f15 are set as the lamp voltage command value V1 and filament voltage command value V2 so that the inverter circuit generates an output proportional to the addition of the both, and thereafter the both components are separated by the filters and then applied to the discharge lamp La and to the filaments F1 and F2 respectively. As a result, in the preheating mode, the lamp voltage command value V1 is set small amplitude and the filament voltage command value V2 are set large amplitude, so that, in the non-discharging mode of the discharge lamp La shown by the solid line 1 in FIG. 24, the high filament voltage can be secured with the sufficient preheating current, while avoiding an unnecessary increase in the voltage across the discharge lamp La. In the normal operating mode of the discharge lamp La, further, the lamp voltage command value V1 is set large amplitude and the filament voltage command value V2 is set small amplitude, so that the voltage across the discharge lamp La can be kept at a level necessary for the normal operating, the filament voltage can be made low, the filament preheating current can be made small and the filament loss can be suppressed. Similarly, in the dimming mode, the lamp voltage command value V1 and filament voltage command value V2 are set as necessary one.

Though voltage has been used as the command values in the foregoing explanation, current (lamp current and filament current) may be employed instead. Further, the lamp voltage command value V1 and filament voltage command value V2 may be set at higher one of their frequencies, so long as the frequency can satisfy the operating conditions of the discharge lamp La.

(Embodimetn 14):

In the foregoing embodiment 13, the band pass filters have been used to separate the voltage component to be applied to the filaments and discharge lamp. The present embodiment however is different from the embodiment 13 in that the voltage component to be applied across the discharge lamp La as well as the voltage component to be applied to the filaments F1 and F2 are separated from the carrier, for which purpose a low pass filter is provided for the separation of the lamp application voltage component from the carrier while a high pass filter is provided for the separation between the lamp application voltage and the filament application voltage component.

Figure 26:
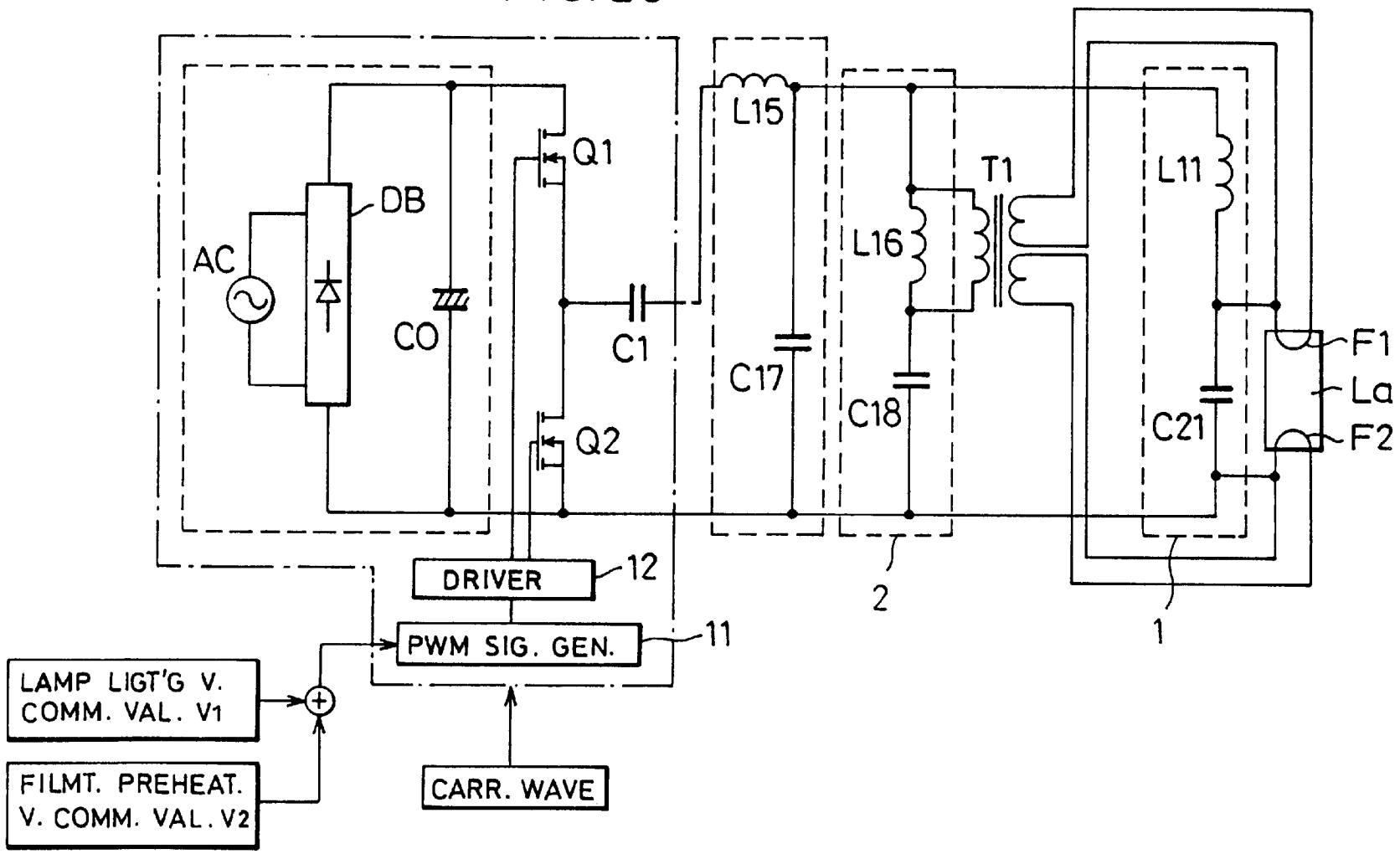
FIG. 26 is a characteristic diagram of the embodiment 14 of the present invention.

More in detail, as shown in FIG. 26, a series circuit of the switching element Q2 and capacitor C1 is connected with a low pass filter of a choke input type including an inductor L15 and a capacitor C17 to remove a carrier component. An inductor L16 is connected in parallel to the primary winding of the transformer T1 so that a series circuit of the inductor L16 and a capacitor C18 forms a high pass filter. The high pass filter is connected in parallel to the capacitor C17.

Figure 27:
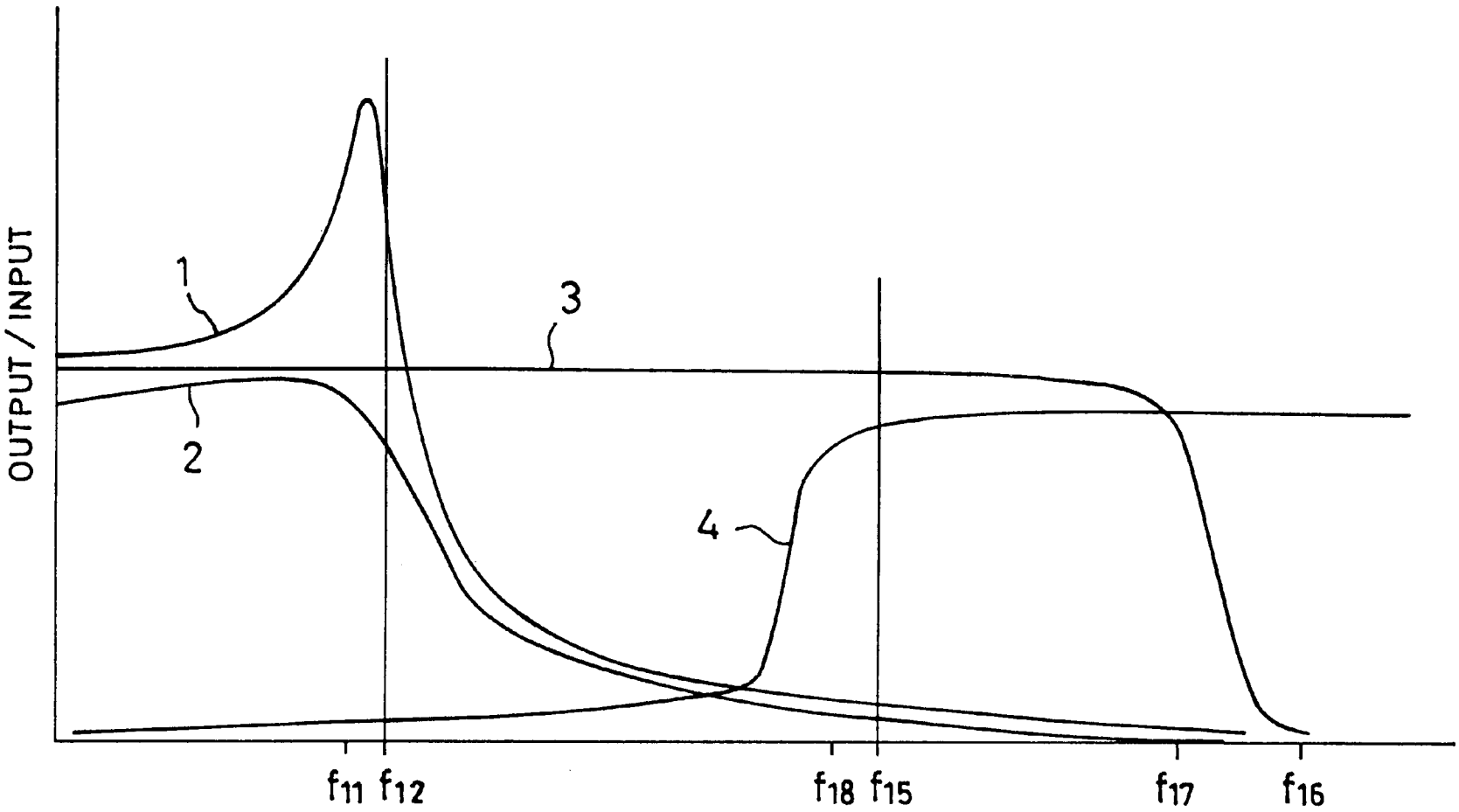
FIG. 27 is a frequency characteristic diagram of the embodiment 14 of the present invention.

The respective filters exhibit such characteristics as shown in FIG. 27. More specifically, as in the embodiment 14, the filter of the inductor L11 and capacitor C21 exhibits such a characteristic as shown by a solid line 1 in FIG. 27 in the non-discharging mode of the discharge lamp La and exhibits such a characteristic as shown by a solid line 2 in FIG. 27 in the operating mode of the discharge lamp La. The filter of the inductor L15 and capacitor C17 exhibits such a characteristic as shown by a solid line 3 in FIG. 27 and thus can remove the carrier component. Its cut-off frequency f17 is expressed as follows.

$$f17=1/2\pi(L15\cdot C17)1/2$$

Further, the filter of the inductor L16 and capacitor C18 exhibits such a characteristic as shown by a solid line 4 in FIG. 27 and can separate a component corresponding to the lamp voltage command value V1 and a component corresponding to the filament voltage command value V2.

Its cut-off frequency f18 is expressed as follows.

$$f18=1/2\pi(L16\cdot C18)1/2$$

Other arrangement and operation are substantially the same as those of the embodiment 13.

Figure 28:
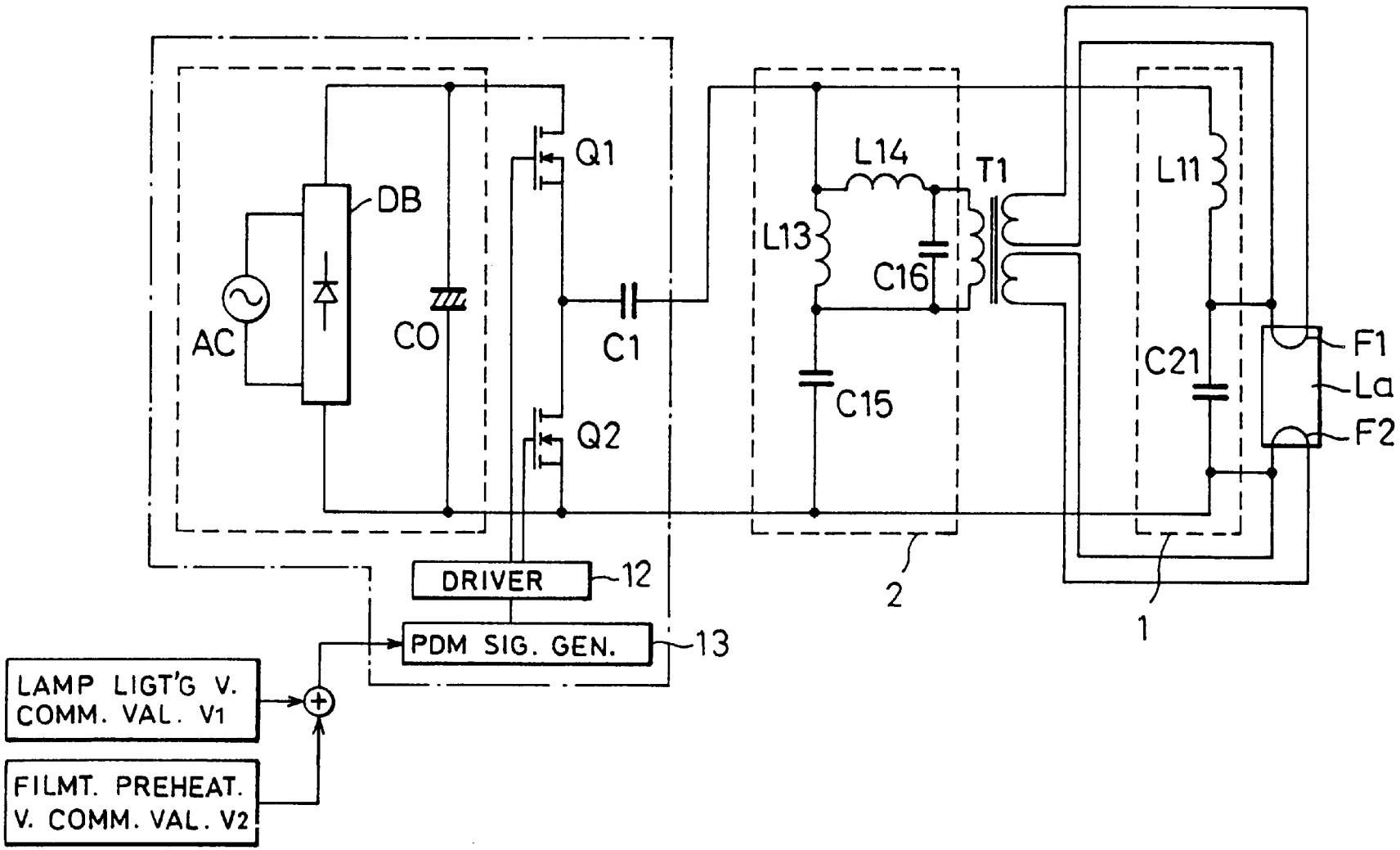
FIG. 28 is a circuit diagram of an electronic ballast for discharge lamps in accordance with an embodiment 15 of the present invention.

(Embodiment 15):

In the present embodiment, as shown in FIG. 28, the PWM signal generator 11 in the arrangement of the embodiment 13 is replaced by a pulse density modulation (PDM) signal generator 13. The PDM signal generator 13 can receive as its input signal an addition of the lamp voltage command value V1 of the frequency f12 and the filament voltage command value V2 of the frequency f15, and can generate an output signal having a pulse density proportional to its input signal. In the illustrated example, the operating frequency of the inverter is set to be higher than the cut-off frequency f14. Other arrangement and operation are substantially the same as those of the embodiment 13. That is, since the voltage component to be applied across the discharge lamp La and the voltage component to be applied to the filaments F1 and F2 are separated by the filters, so that, when the lamp voltage command value V1 and filament voltage command value V2 are suitably set according to the state of the lamp such as the preheating, ignition, normal operating or dimming mode, the control suitable for the respective states can be achieved.

Figure 29:
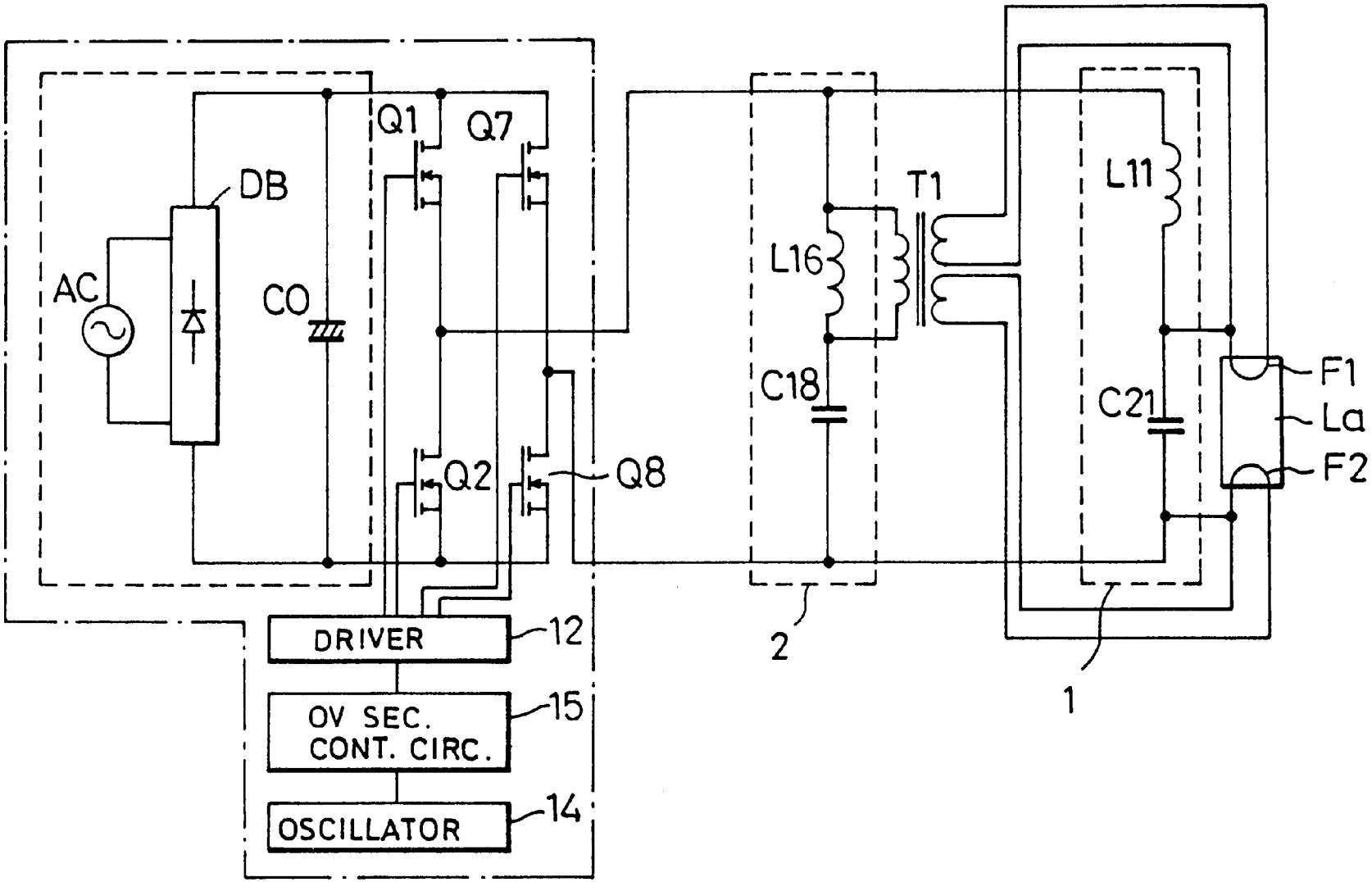
FIG. 29 is a circuit diagram of an electronic ballast for discharge lamps in accordance with an embodiment 16 of the present invention.

(Embodiment 16):

In the present embodiment, as shown in FIG. 29, a full bridge type of inverter circuit is used which comprises 4 switching elements Q1, Q2, Q7 and Q8 of MOS FETs connected in a bridge form. As well known, the switching elements Q1 and Q2, and Q7 and Q8 in arms of the bridge each connected in series are controlled so as not to be turned ON at the same time, while the switching elements Q1 and Q8, and Q2 and Q7 located at diagonal positions of the bridge are controlled so that the diagonal switching elements have such durations as able to be turned ON at the same time. In the present embodiment, a simultaneous OFF enable duration is provided to all of the switching elements Q1, Q2, Q7 and Q8 and this duration (dead time) is variable.

More specifically, an output of an oscillator 14 is input to a 0-V duration control circuit 15 for adjustment of the dead time to generate a control signal, and then the control signal is applied to the switching elements Q1, Q2, Q7 and Q8 through the driver 12 to turn ON and OFF the switching elements Q1, Q2, Q7 and Q8.

Outputs of the inverter circuit obtained from junction points of the switching elements Q1 and Q2 and of the switching elements Q7 and Q8 are applied to the both ends of the discharge lamp La and the filaments F1 and F2 through respective filters respectively. More in detail, the voltage component to be applied across the discharge lamp La is passed through a low pass filter as a series circuit of the inductor L11 and capacitor C21; whereas, the voltage component to be applied to the filaments F1 and F2 is passed through a filter as a series circuit of the inductor L16 and capacitor C18.

Figure 30:
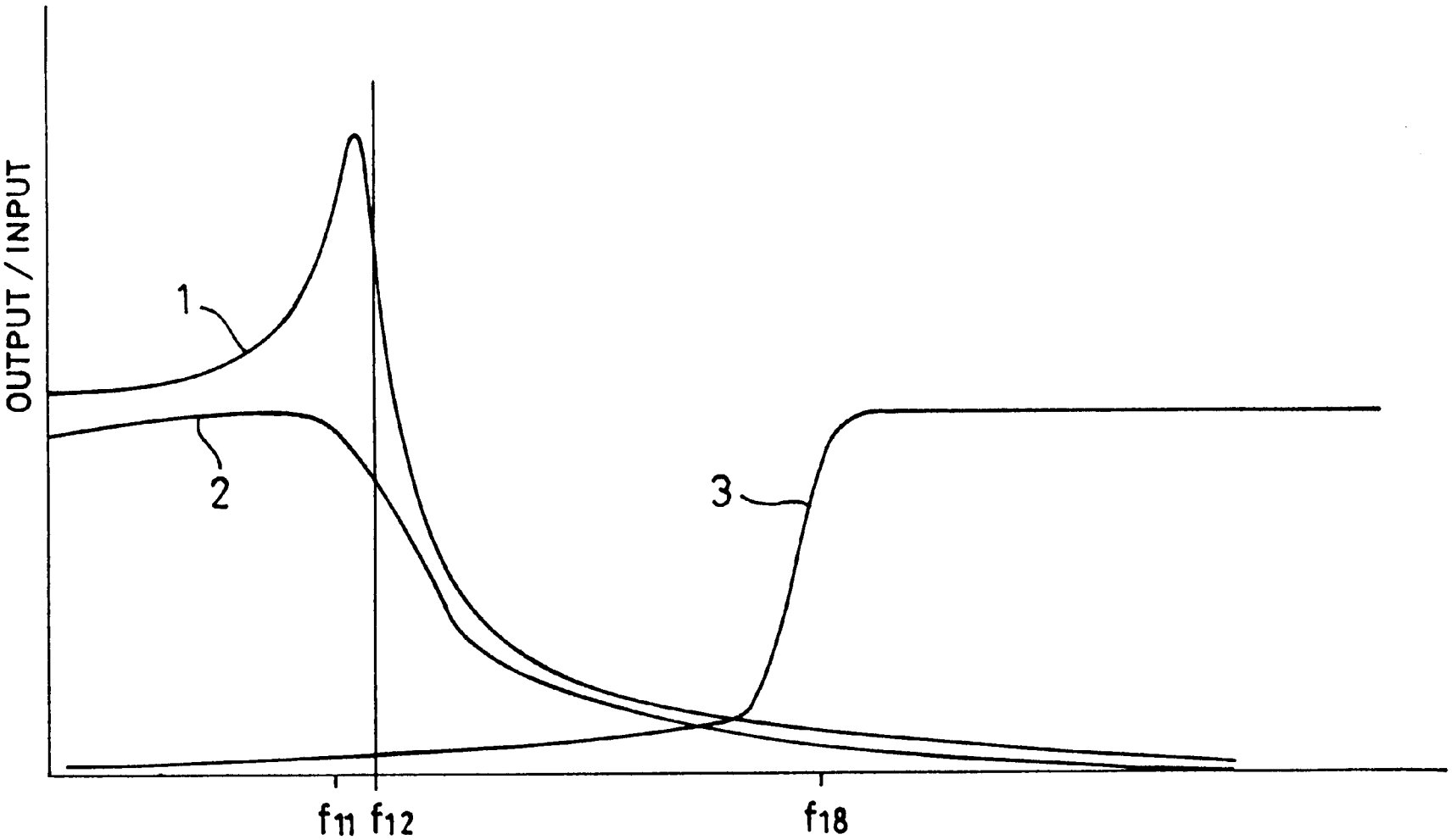
FIG. 30 is a frequency characteristic diagram of the embodiment 16 of FIG. 29 of the present invention.

The filter of the inductor L11 and capacitor C21, as already explained in the embodimetn 13, exhibits such a characteristic as shown by a solid line 1 in FIG. 30 in the non-discharging mode of the discharge lamp La, and exhibits such a characteristic as shown by a solid line 2 in FIG. 30 in the operating mode of the discharge lamp La. In the non-discharging mode, its resonance frequency f11 is written as follows.

$$f11=1/2\pi(L11\cdot C21)1/2$$

In this connection, the frequency f12 in the normal operating mode of the discharge lamp La is set to be somewhat high in the vicinity of the resonance frequency f11.

The filter of the inductor L16 and capacitor C18, on the other hand, exhibits such a characteristic as shown by a solid line 3 in FIG. 30, and its cut-off frequency f18 is written as follows.

$$f18=1/2\pi(L16\cdot C18)1/2$$

The pass band of this filter having a characteristic shown by a line 3 is set so as to block the fundamental wave of the frequency f12 as the operating frequency of the inverter circuit and to allow passage of harmonics thereof.

Figure 31A:
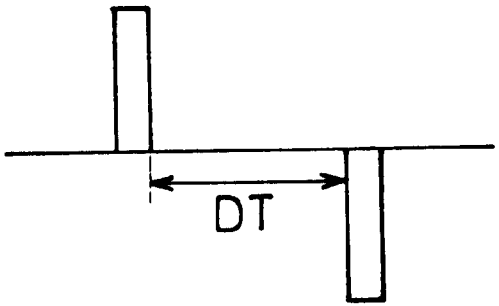
FIGS. 31*a* to 31*c* are diagrams for explaining the operation of the embodiment 16 of FIG. 29 respectively.
Figure 31B:
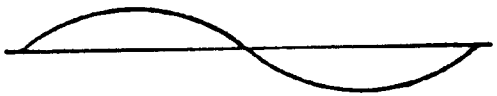
Figure 31C:
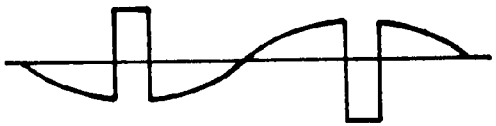

In the preheating mode, as shown in FIG. 31*a*, the 0-V duration control circuit 15 is controlled to increase a dead time DT. In this case, since a voltage appearing between the junction points of the switching elements Q1 and Q2 and Q7 and Q8 in the respective arms of the bridge circuit has such a waveform as a pulse, harmonic components contained in the voltage waveform are increased. In other words, as shown in FIG. 31(*c*), more components can be passed through the filter of the inductor L16 and capacitor C18 and thus the voltage component percentage to be applied to the filaments F1 and F2 can be increased. Further, since the ON durations of the switching elements Q1, Q2, Q7 and Q8 are short, the voltage component percentage to be applied across the discharge lamp La become low as shown in FIG. 31(*b*).

Figure 32A:
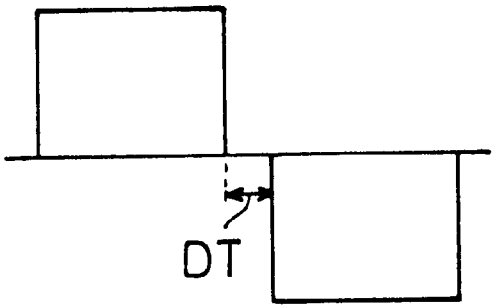
FIGS. 32*a* to 32*c* are characteristic diagrams of the embodiment 16 of FIG. 29.
Figure 32B:
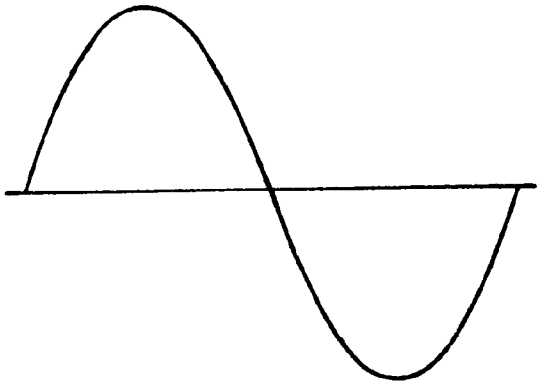
Figure 32C:
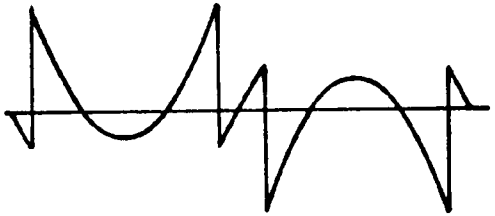

Meanwhile, in the operating mode of the discharge lamp La, the dead time DT is made small as shown in FIG. 32(*a*). This results in that the voltage component percentage to be applied across the discharge lamp La increases as shown in FIG. 32(*b*) and the harmonic components contained in the waveform of the voltage appearing between the junction points of the switching elements Q1 and Q2, and Q7 and Q8 decrease, thus decreasing the voltage component percentage to be applied to the filaments F1 and F2 as shown in FIG. 32(*c*).

Figure 33:
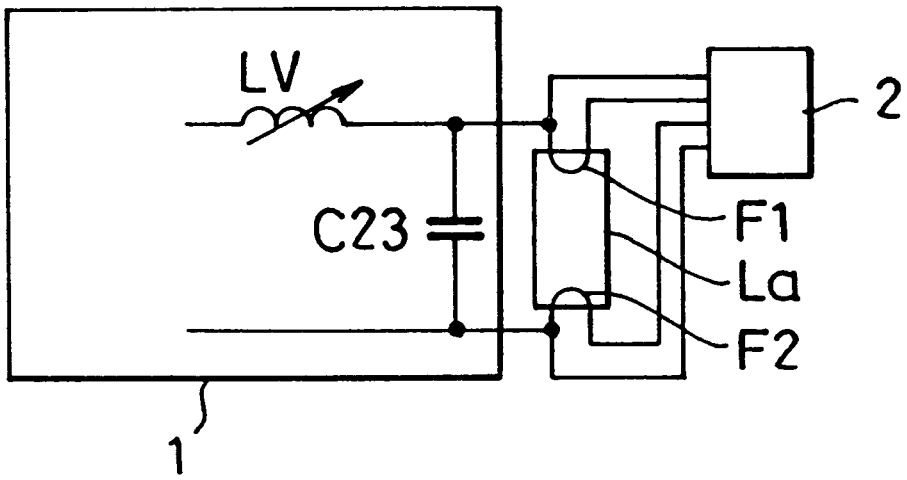
FIG. 33 is a circuit diagram of an electronic ballast for discharge lamps in accordance with an embodiment 17 of the present invention.

(Embodiment 17):

In the present embodiment, as shown in FIG. 33, the filament resonance circuit 2 is provided for applying a voltage to the filaments F1 and F2 as in the embodiment 1, and impedance elements, whose impedance is variable, are inserted in paths leading from the main resonance circuit 1 to the both ends of the discharge lamp La. In the example shown in FIG. 33, the impedance elements include a variable inductor Lv connected in series with the discharge lamp La and a capacitor C23 connected in parallel to the discharge lamp La.

Figure 34:
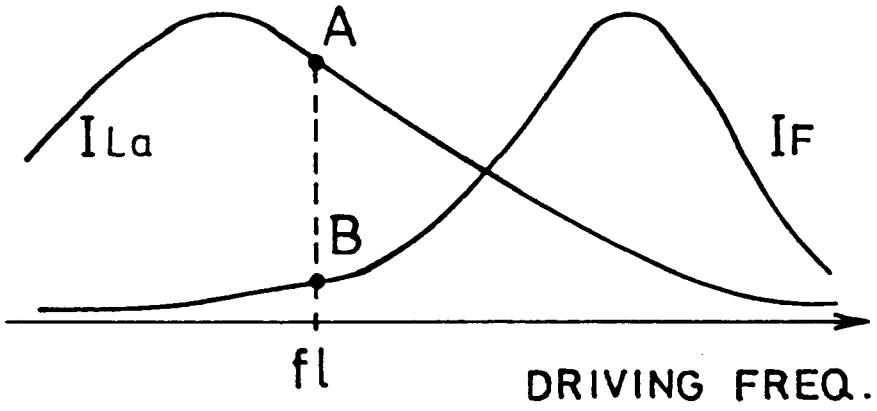
FIGS. 34 and 35 are frequency characteristic diagrams of the embodiment 17 of FIG. 33.
Figure 35:
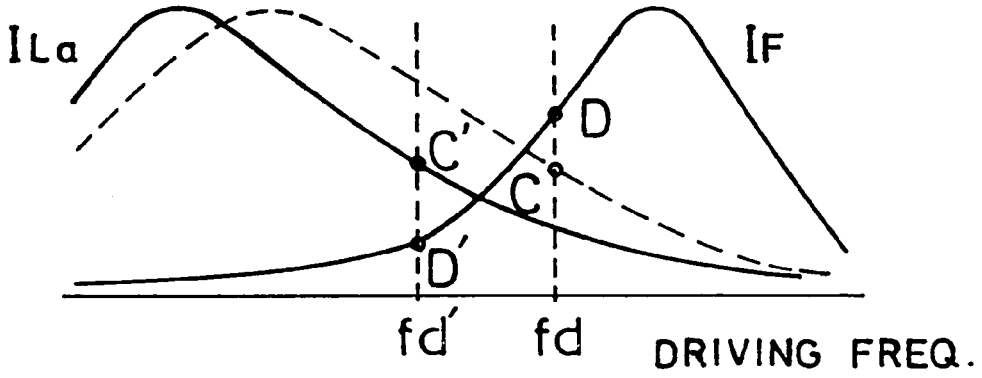

Assume now that the lamp current ILa to be supplied to the discharge lamp La from the main resonance circuit 1 as well as the filament current IF to be supplied to the filaments F1 and F2 from the filament resonance circuit 2 have such frequency characteristics as shown in FIG. 34, and that the discharge lamp La is in the normal operating mode at the operating frequency f1, i.e., the lamp current corresponding to a point A flows. Since the main resonance circuit 1 and filament resonance circuit 2 are driven at the same operating frequency, the filament current IF corresponding to a point B flows. When it is desired to perform the dimming by changing only the operating frequency of the main resonance circuit 1 and filament resonance circuit 2, the operating frequency is shifted to its higher frequency side. Assuming now that the dimming is carried out at the dimming frequency fd as shown in FIG. 35, then the lamp current ILa corresponding to a point C flows in a frequency characteristic of the main resonance circuit 1 shown by a dotted line and the filament current IF corresponding to a point D flows. The slim discharge lamp La explained in the "Problem to be solved by the Invention" has such a restrictive requirement that the upper limit of the filament current IF in the dimming mode must be lower than the lower limit thereof in the preheating mode. For this reason, the restrictive requirement can be more easily satisfied by minimizing the current value at the point D.

To this end, according to the present embodiment, the frequency characteristic of the lamp current La supplied to the discharge lamp La from the main resonance circuit 1 is shifted as shown by a solid line in FIG. 35 in the dimming mode, so that the filament current IF is small while keeping the lamp current La at the same value. That is, in the case of the circuit shown in FIG. 33, since the resonance point can be shifted by using the variable inductor Lv, the dimming frequency fd' for obtaining the same lamp current ILa as at the point C can be pulled down, with the result that the filament current IF can be reduced. The lamp current corresponds to a point C' and the filament current corresponds to a point D'.

Figure 36:
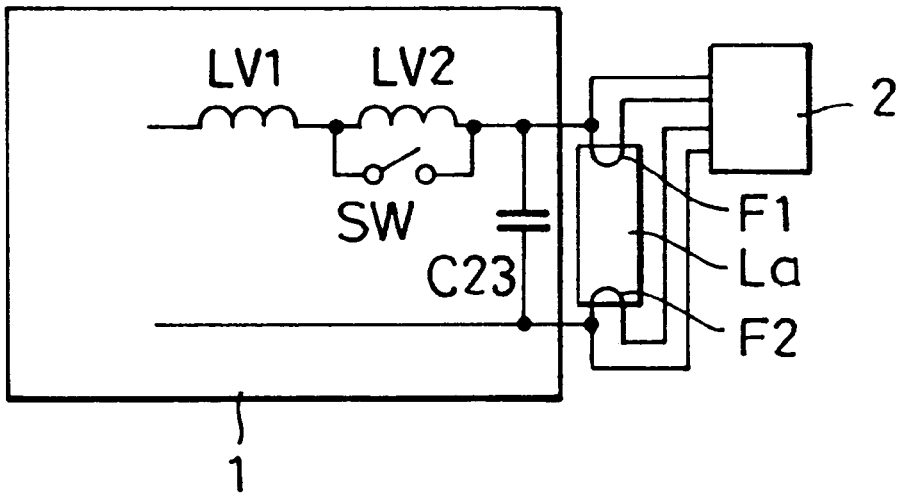
FIGS. 36 and 37 are circuit diagrams of other modifications of the embodiment 17 of FIG. 33 respectively.

As will be clear from the foregoing explanation, it is only required to switch between the frequency characteristics in the preheating mode and dimming mode, so that the variable inductor Lv may be made up of a pair of inductors LV1 and LV2 connected in series, a switching element SW being connected in parallel to one LV2 of the inductors LV1 and LV2, as shown in FIG. 36. With this arrangement, the switching element SW is previously put in its OFF state to complete a resonance circuit including the series circuit of the 2 inductors LV1 and LV2 and also including the capacitor C23 in the preheating mode or normal operating mode; whereas, the switching element SW is turned ON to complete a resonance circuit of the inductor LV1 and capacitor C23 in the dimming mode. Such an arrangement enables shift of the frequency characteristic of the lamp current ILa in the dimming mode to its lower frequency side and thus enables reduction of the filament current IF in the dimming mode. In this connection, when impedances of the respective parts in the circuit in the dimming mode are adjusted, the filament current IF can be adjusted to its optimum value for the dimming amount that is its upper limit or less.

Figure 37:
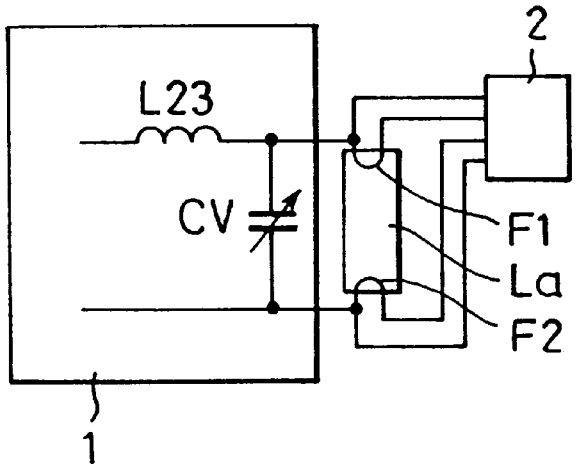

Though the inductance component in the resonance circuit has been made variable in the foregoing embodiment, a capacitance component may be made variable with use of an inductor L23 and a variable capacitor Cv, as shown in FIG. 37.

Figure 38:
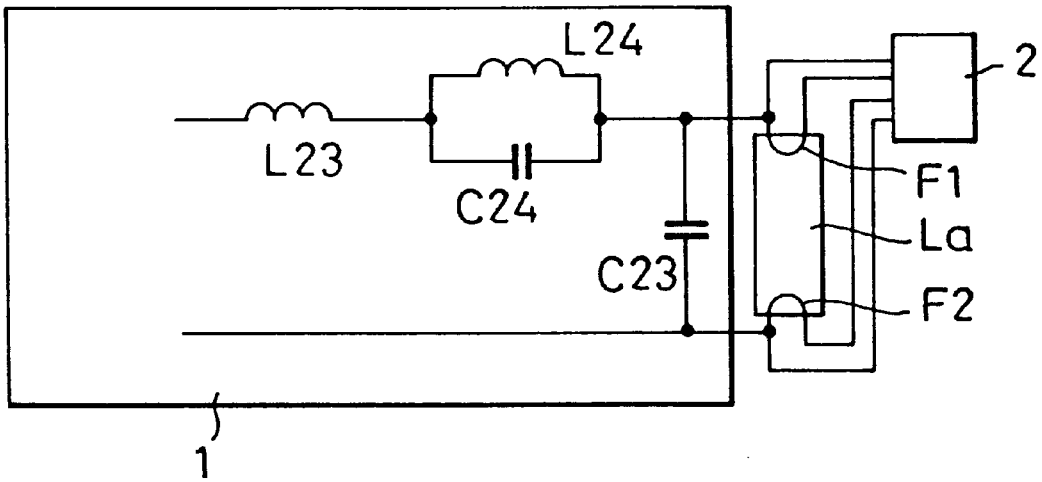
FIG. 38 is a circuit diagram of an electronic ballast for discharge lamps in accordance with an embodiment 18 of the present invention.

(Embodiment 18):

In the present embodiment, as shown in FIG. 38, a resonance circuit having such an antiresonance point that the lamp current ILa becomes substantially zero at a predetermined frequency is provided in a path leading from the main resonance circuit 1 to the discharge lamp La. More in detail, a parallel resonance circuit of an inductor L24 and a capacitor C24 as well as the discharge lamp La are connected in series with the inductor L23, and the capacitor C23 is connected in parallel to the discharge lamp La.

Figure 39:
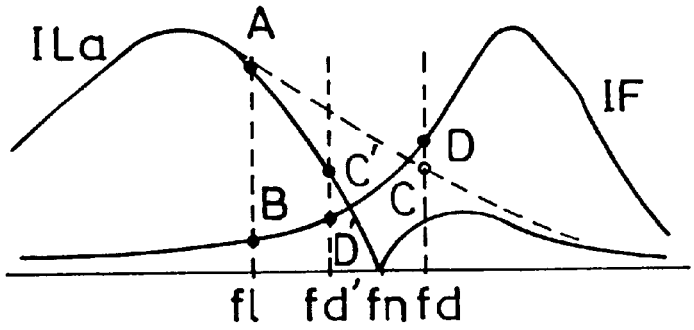
FIG. 39 is a frequency characteristic diagram of the embodiment 18 of FIG. 38.

When such a circuit is provided, the lamp current ILa has such a characteristic as shown by a solid line in FIG. 39. That is, when compared with such a characteristic of a conventional lamp current ILa as shown by a dotted line in FIG. 39, the lamp current ILa with respect to frequency is largely reduced on a higher frequency side of the resonance point and the lamp current ILa becomes substantially zero at a frequency fn. It is assumed herein that the main resonance circuit 1 and filament resonance circuit 2 are driven at the same operating frequency.

Assume now that the operating frequency is the operating frequency f1 and the lamp current ILa at a point A flows. When the parallel resonance circuit of the inductor L24 and capacitor C24 is not present, the lamp current ILa is controlled on a broken line in FIG. 39 in the dimming mode, so that, for the purpose of obtaining the lamp current, e.g., at a point C, it is necessary to set the operating frequency at the dimming frequency fd. The then filament current IF corresponds to a point D. According to the present embodiment, on the other hand, the use of the parallel resonance circuit causes the lamp current ILa to be controlled on the solid line in FIG. 39. Thus, in order to obtain the lamp current ILa equivalent to that at the point C, it is required to set the operating frequency at the dimming frequency fd'. As a result, the filament current IF in the dimming mode corresponds to a point D' and the requirement can be easily satisfied that the upper limit of a filament current Ir in the dimming mode does not exceed the lower limit of the filament current IF in the preheating mode.

Figure 40:
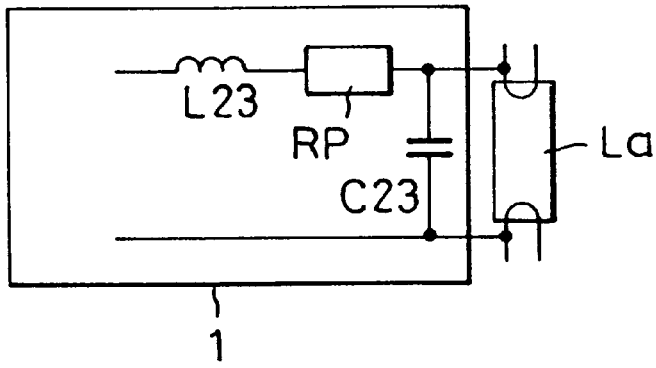
FIGS. 40 and 41 are circuit diagrams of other modifications of the embodiment 18 of FIG. 39 respectively.
Figure 41:
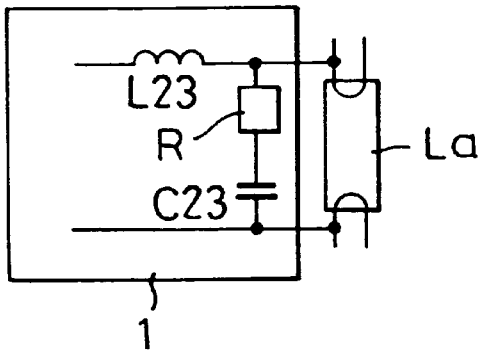

In the present embodiment, as shown in FIG. 40, a parallel resonance circuit Rp of the inductor L24 and capacitor C24 is connected in series with the inductor L23. However, the parallel resonance circuit Rp may be connected in series with the capacitor C23 as shown in FIG. 41. In this connection, when the impedances of the respective parts in the circuit in the dimming mode are adjusted, the filament current IF optimum for the dimming amount can be adjusted to a value that is equal to or less than the upper limit of the filament current IF.

Figure 42:
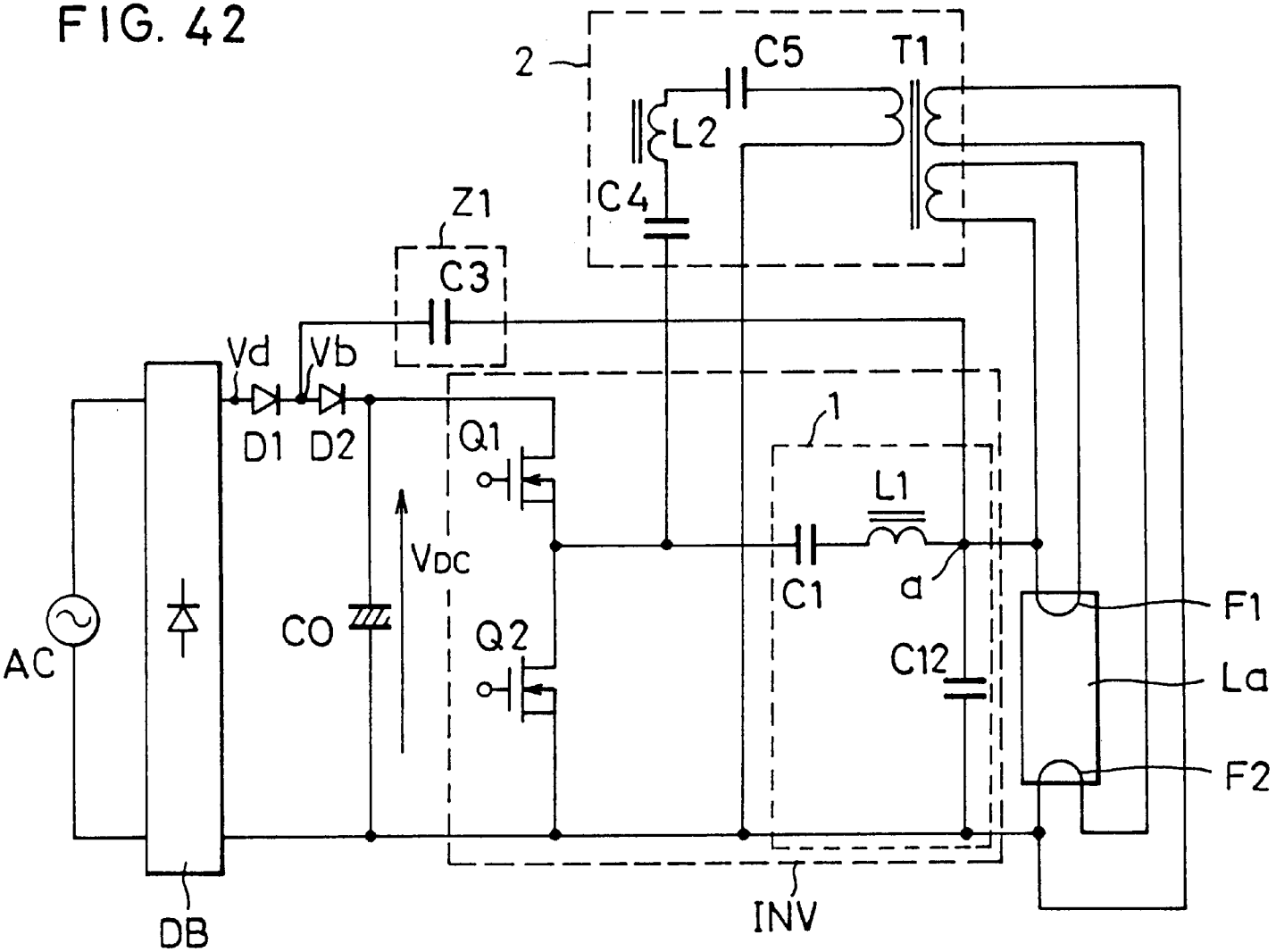
FIG. 42 is a circuit diagram of an electronic ballast for discharge lamps in accordance with an embodiment 19 of the present invention.

(Embodiment 19):

In the present embodiment 19, for the purpose of suppressing harmonic distortion in the input current from the AC power source in the embodiment 1, the main circuit is arranged so that, as shown in FIG. 42, one end of a vibration element of an inverter section INV connected to the smoothing capacitor C0 is connected to high potential one of output terminals of the full-wave rectification circuit DB via an impedance element Z1 for power feedback.

In this case, the inverter section INV includes a main resonance circuit 1 having a series circuit of the switching elements Q1 and Q2 of MOS FETs connected between both ends of the capacitor C0 and also having a series circuit of the DC blocking capacitor C1 and inductor L1 connected to a junction point of the both switching elements Q1 and Q2, a discharge lamp having the filaments F1 and F2, power-side ends of which are connected to both ends of the switching element Q2 through the above series circuit, and resonating capacitor C12 connected to the power-side ends of the filaments F1 and F2.

A filament resonance circuit 2 shares the switching elements Q1 and Q2 with the inverter section INV and also shares the smoothing capacitor C0 as their power supply. Further, the primary winding of the transformer T1 is connected between a drain and source of the switching element Q2 through a series circuit of the capacitor C5, inductor L2 and capacitor C4; and two secondary windings of the transformer T1 are connected to the filaments F1 and F2 of the discharge lamp La. Also connected to control ends of the switching elements Q1 and Q2 is a controller (not shown) which controls the ON and OFF operation of the switching elements Q1 and Q2 respectively. The capacitor C3 is connected between a junction point of the inductor L1 and capacitor C12 as an input harmonic distortion suppressing circuit and a junction point connected in series with the diodes D1 and D2 connected between the diode bridge DB and capacitor C0.

Explanation will next be made briefly as to the operation of the circuit. In the electronic ballast for discharge lamps, the above controller cause the switching elements Q1 and Q2 to be alternately turned ON and OFF at a high speed, thus operating the discharge lamp La at a high frequency.

In this device, further, a series circuit of the diodes D1 and D2 is connected between the high-potential one of the output terminals of the full-wave rectifier DB and the smoothing capacitor C0, a junction point of the inductor L1 and discharge lamp La is connected to a junction point of the both diodes D1 and D2 through the impedance element Z1 for the power feedback. so that pull-in of the input current to the side of the impedance element Z1 and charging of the smoothing capacitor C0 are carried out according to a potential (amplitude of a high frequency voltage) at the junction point of the inductor L0 and discharge lamp La. More specifically, assuming that Vd denotes a potential at high-potential one of the output terminals of the full-wave rectifier DB, Vb denotes a potential at the junction point of the both diodes D1 and D2, and Va denotes a potential (voltage of the feedback power) at a junction point a of the inverter section INV and impedance element, i.e., at a junction point of the inductor L1 and discharge lamp La; then a difference voltage between the voltages Vb and Va when the voltage Va becomes lower than the voltage Vb is applied to the impedance element Z1 to accumulate charge in the impedance element Z1. When the voltage Va becomes higher than the voltage Vb, on the other hand, the charge accumulated in the impedance element Z1 is charged into the smoothing capacitor C0 through the diode D2. Since such operations are repeated throughout all the commercial periods of the A.C. power source AC, the input current can always flow, which results in that the input power factor becomes high and the harmonic distortion of the input current is improved. Accordingly, in the case of the electronic ballast for discharge lamps of FIG. 42, the provision of the impedance element can eliminate the need for inserting a large inductor between the output terminal of the full-wave rectifier DB and the smoothing capacitor CO or for inserting a chopper circuit in the input stage, whereby the input harmonic distortion can be suppressed without involving an increase in the size of the device.

In the present embodiment, the main resonance circuit 1 and filament resonance circuit 2 can have independent resonance characteristics such as the resonance characteristic I1*a* of the lamp current and the resonance characteristic IF of the filament current as shown in FIG. 2. Accordingly, the filament resonance circuit 2 can supply the preheating current having a sufficient magnitude in the preheating mode and can reduce the filament current in the normal operating mode or in the dimming mode.

In the present embodiment, when such a T5 lamp having a large lamp impedance per unit length excluding the lamp caps as shown in Table 1 is used as the discharge lamp La, the lamp voltage with much power consumption in the normal operating mode becomes high, which results in that a voltage VDC across the smoothing capacitor C0 in the normal operating mode tends to increase. To avoid this, the input current can be decreased by increasing the impedance element Z1 for the power feedback in such a manner the voltage VDC has a suitable value in the normal operating mode, whereby, even when the power consumption is less and the lamp impedance is high originally in the preheating mode or in the dimming mode, it becomes possible to make it difficult for the voltage VDC to rise.

In the present embodiment, further, the capacitor C3 is used as the impedance element Z1, but the capacitor C3 is connected at its one end to a junction point of the inductor L1 of the main resonance circuit 1 and power-side one of the ends of the filament F1 and is not connected in series with the filament resonance circuit 2. For this reason, the filament resonance circuit 2 does not contributes to the charging operation of the smoothing capacitor C0. In such a circuit system that the lamp current and the filament current flow through the same inverter as shown in FIG. 16, preheating is carried out by the voltage across the capacitor C2 connected between non-power side one of the ends of the filaments F1 and F2, thus eliminating the need for supplying the filament current by the main resonance circuit 1 and thus for supplying the filament current. As a result, in the present embodiment, a voltage Va across the lamp in the preheating mode can be made small, a potential difference between a potential at the junction point of the both diodes D1 and D2 and a potential at the junction point of the inductor L1 and filament F1, thus enabling suppression of an increase in the voltage VDC across the smoothing capacitor CO.

In this way, according to the present embodiment, a slim lamp demanding strict preheating requirements can be sufficiently preheated, ignited and dimmed with the small filament current, while suppressing the harmonic distortion in the input current.

Figure 43:
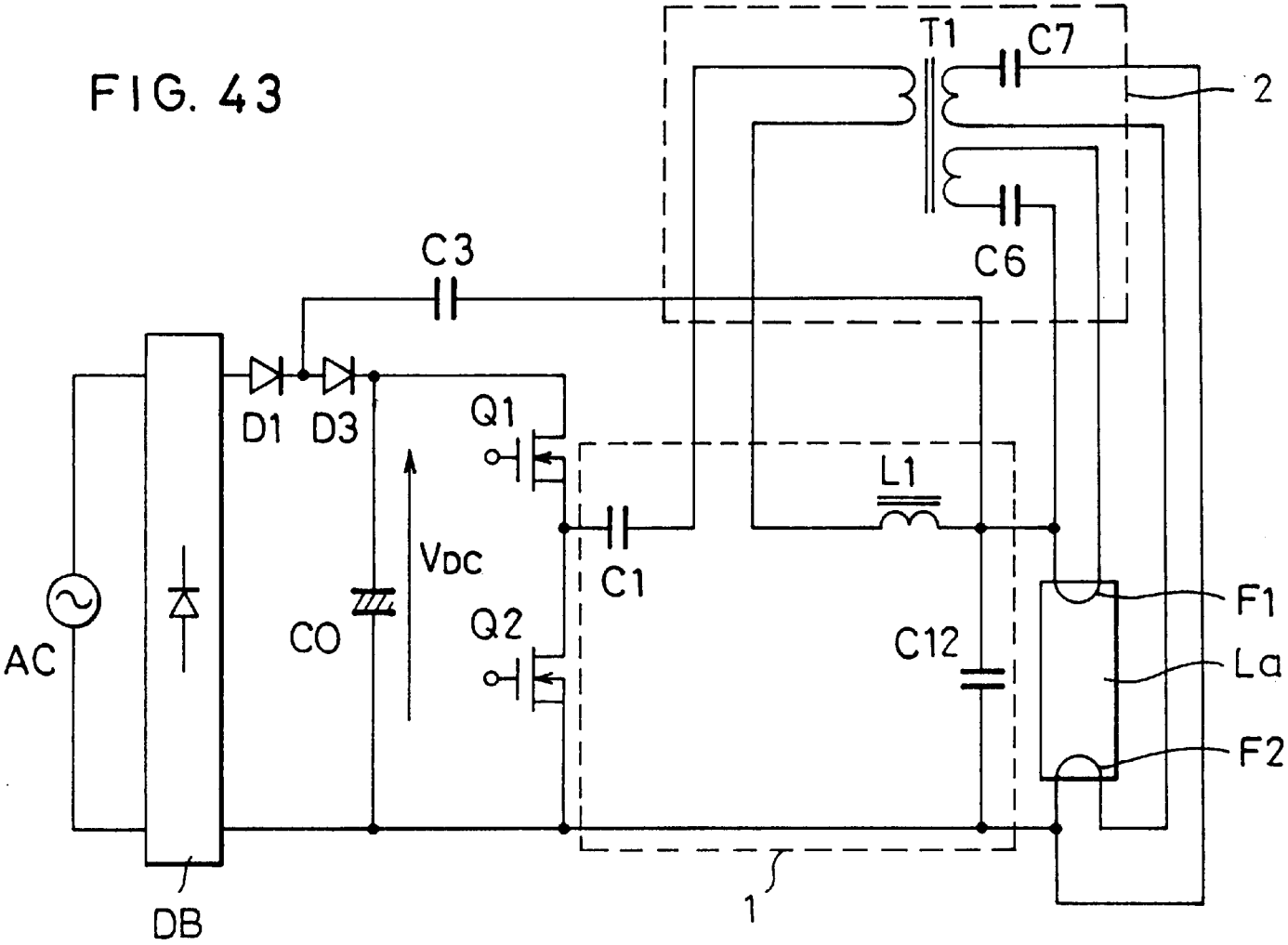
FIG. 43 is a circuit diagram of an electronic ballast for discharge lamps in accordance with an embodiment 20 of the present invention.

(Embodiment 20):

The basic arrangement and operation of the present embodiment are substantially the same as those of the embodiment 19, except that, as shown in FIG. 43, there is provided a filament resonance circuit 2 in which the primary winding of the transformer T1 is connected between the capacitor C1 and inductor L1 in series therewith (that is, the primary winding of the transformer T1 is connected in a resonance current path of the main resonance circuit 1, and the two secondary windings of the transformer T1 are connected to the filaments F1 and F2 through the capacitors C6 and C7 respectively. In other words, in the present embodiment, the filament current is extracted from the inductor L1 path of the main resonance circuit 1 through the transformer T1 to set the filament current characteristic independently of the main resonance circuit 1. To this end, in the present invention, the two secondary windings of the transformer T1 are connected to the filaments F1 and F2 through the capacitors C6 and C7 respectively to thereby provide a resonance characteristic different from that of the main resonance circuit 1. Accordingly, in accordance with the present embodiment, as in the embodiment 19, the filament current in the operating mode can be reduced. Further, when such a lamp having a large lamp impedance per unit length as the T5 lamp is used, an increase in the voltage VDC across the smoothing capacitor C0 can be further suppressed even in the preheating mode or in the dimming mode.

In this conjunction, when the transformer T1 comprises a leakage transformer, the primary winding of the transformer T1 and the inductor L1 can be commonly used.

Figure 44:
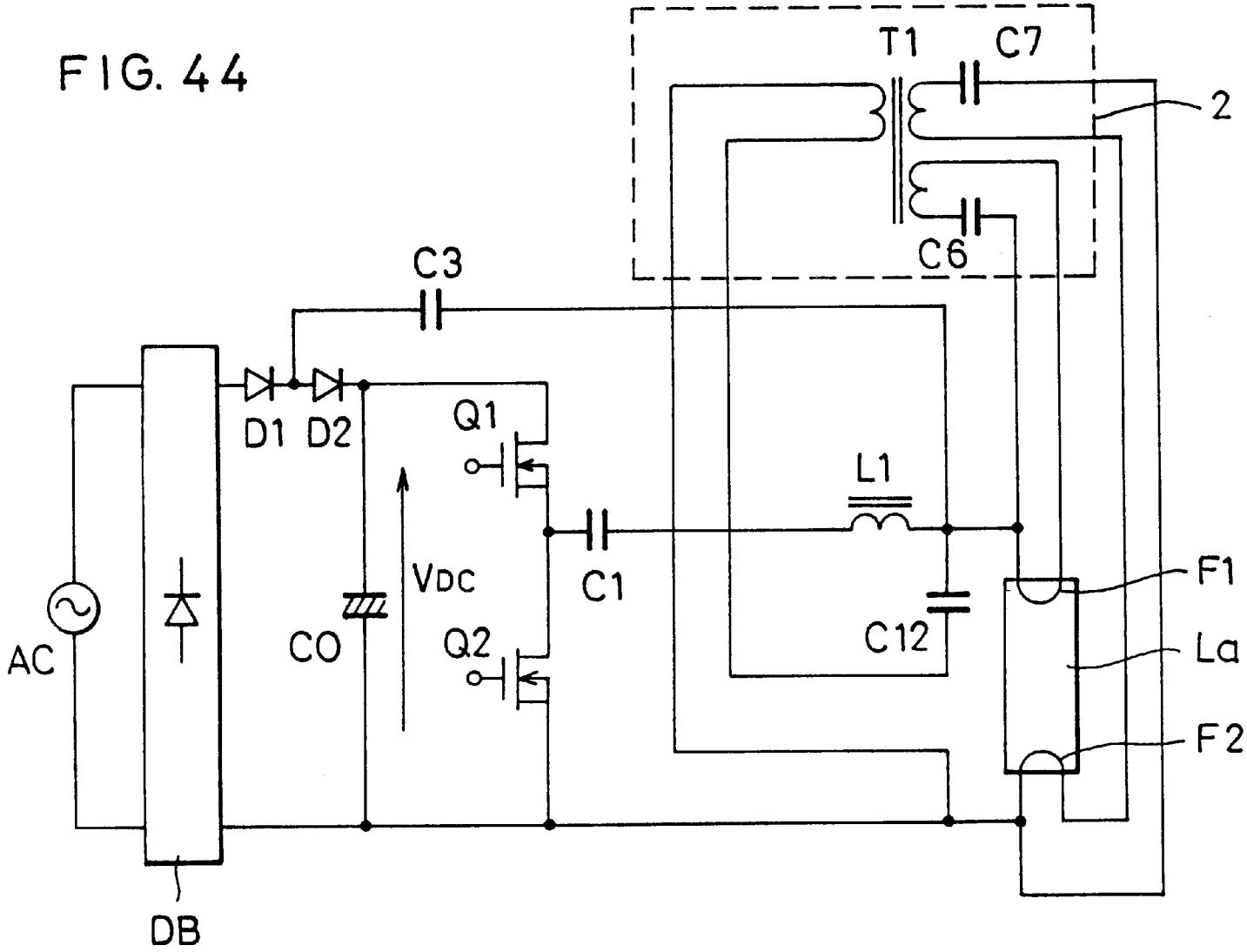
FIG. 44 is a circuit diagram of an electronic ballast for discharge lamps in accordance with an embodiment 21 of the present invention.

(Embodiment 21):

The basic arrangement of the present embodiment is substantially the same as that of the embodiment 20, except that, as shown in FIG. 44, the primary winding of the transformer T1 is connected in series with the capacitor C12 connected between the power-side ends of the filaments F1 and F2 of the discharge lamp La. As in the embodiment 20, the two secondary windings of the transformer T1 are connected to the filaments F1 and F2 through the capacitors C0 and C7 respectively to provide different resonance characteristics to the main resonance circuit 1 and filament resonance circuit 2. In other words, the filament resonance circuit 2 can independently set the filament current. Accordingly, even in the present embodiment, the filament current in the operating mode can be reduced as in the embodiments 19 and 20.

Further, when such a lamp having a large lamp impedance per unit length as the T5 lamp is used, an increase in the voltage VDC across the smoothing capacitor C0 in the preheating mode or in the dimming mode can be suppressed and the filament current in the operating mode can also be reduced.

Figure 45:
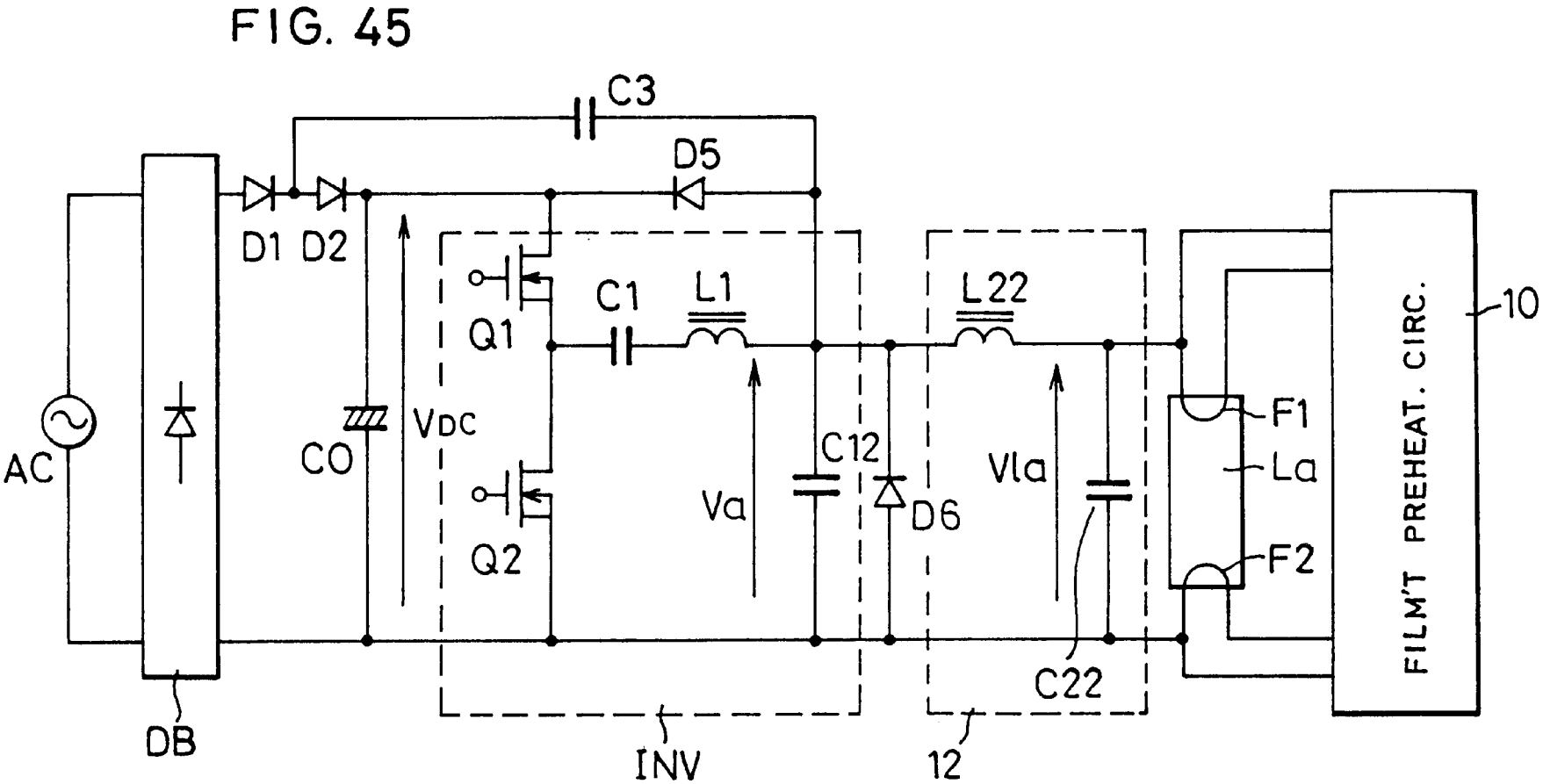
FIG. 45 is a circuit diagram of an electronic ballast for discharge lamps in accordance with an embodiment 22 of the present invention.

(Embodiment 22):

The present embodiment is substantially the same as the embodiment 19 in basic arrangement and is featured in that, as shown in FIG. 45, a second resonance circuit 12 including an inductor L22 and a capacitor C22 is provided between the discharge lamp La and inverter circuit INV. In this case, the capacitor C3 as the impedance element Z1 for the power feedback in the embodiment 19 is connected at its one end to a junction point of the both diodes D1 and D2 and connected at the other end to a junction point of the inductor L1 and capacitor C12. That is, a voltage at the junction point of the inductor L1 and capacitor C12 is used as feedback power. The capacitor C22 is connected between the power-side ends of the filaments F1 and F2. Further, the filament F1 of the discharge lamp La is the filament resonance circuit 2 shown in the embodiments 19 to 21.

In this way, in the present embodiment, since the voltage Va of the capacitor C12 as the feedback power can be set independently of the lamp voltage V1*a*, the amplitude of the voltage Va at the time of preheating the filaments F1 and F2 can be reduced and an increase in the voltage VDC across the smoothing capacitor C0 can be further suppressed. Further, when such a lamp having a large lamp impedance per unit length as the T5 lamp is employed, the voltage across the lamp in the normal operating mode can be made larger than that when the prior art lamp is connected, a difference in the across-lamp voltage V1*a* between the preheating mode and dimming mode can be made small, the impedance of the second resonance circuit 12 can be made small, and thus the inductor L22 can be made small. Furthermore, since the impedance of the capacitor C3 as the feedback impedance element Z1 can be made large as in the embodiment 19, a small size of the capacitor C3 can be used.

Figure 46:
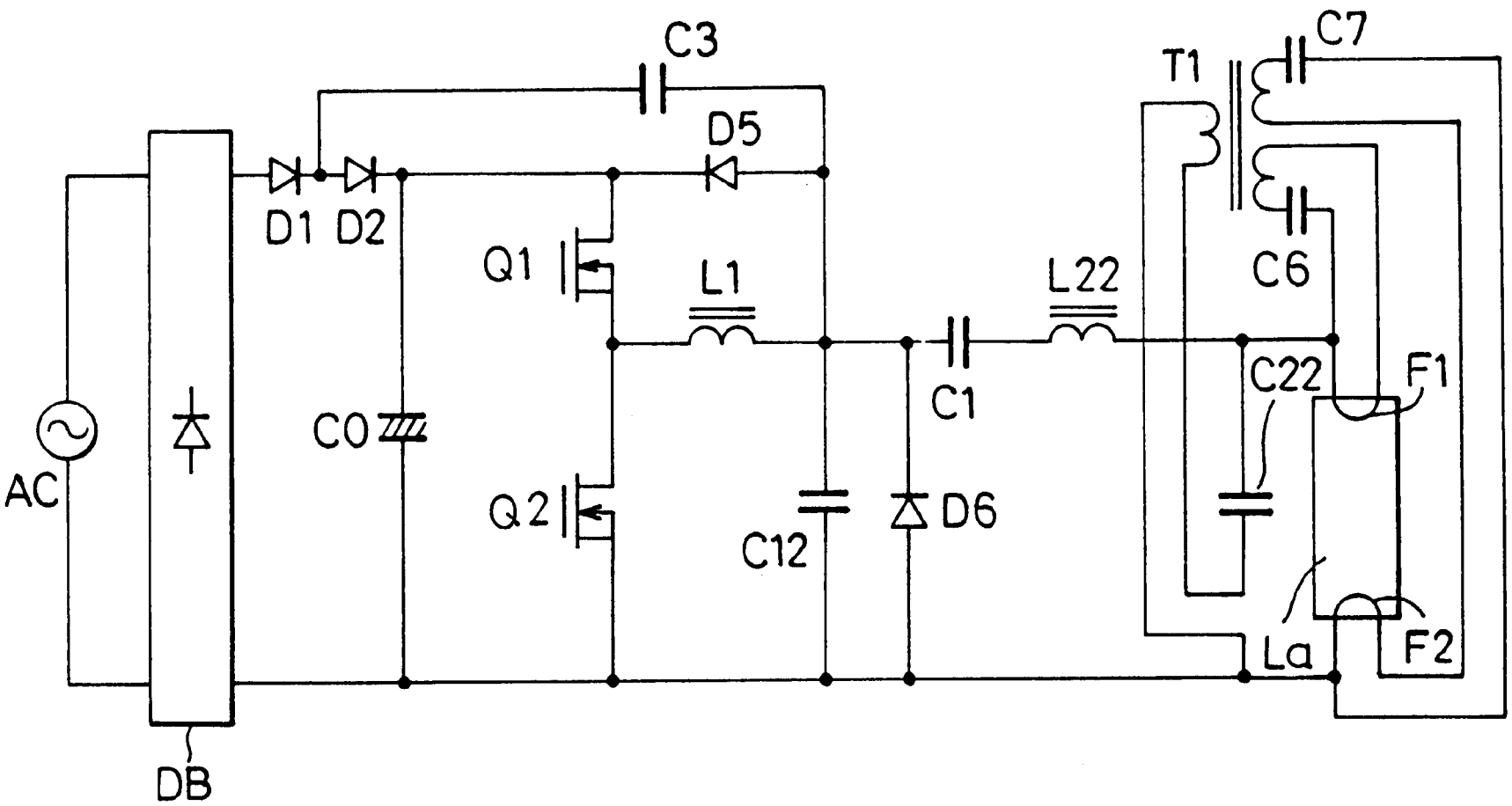
FIG. 46 is a circuit diagram of an electronic ballast for discharge lamps in accordance with an embodiment 23 of the present invention.

(Embodiment 23):

The basic arrangement of the present embodiment shown in FIG. 46 is substantially the same as that of the embodiment 22 and the filament resonance circuit has a circuit configuration similar to that in the embodiment 21. In the embodiment 22, the DC blocking capacitor C1 has been inserted in series with the inductor L1 as the primary resonance circuit; whereas, in the present embodiment, the capacitor C1 is inserted in series with the inductor L22 as the secondary resonance circuit, which makes no significant difference in operation between the both. Even the present embodiment is also substantially the same as the embodiments 21 and 22 with respect to operation.

Figures 20A, 20B, 20C, 20D:
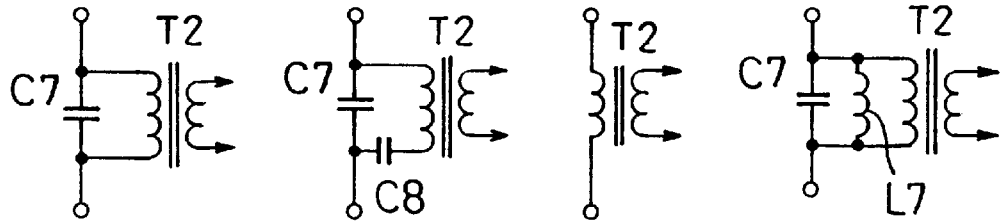
FIGS. 20*a* to 20*d* are other modifications of the embodiment 11 of FIG. 19 respectively.
Figure 47:
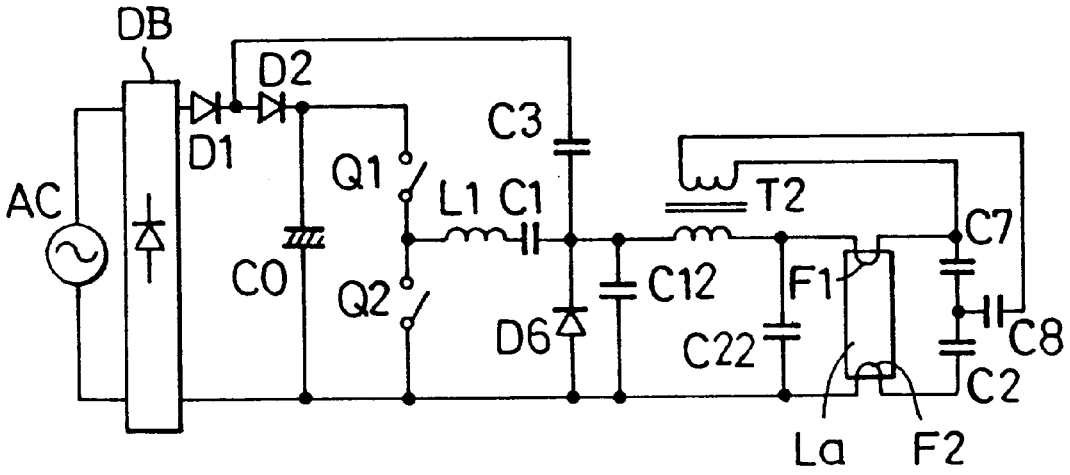
FIG. 47 is a circuit diagram of an electronic ballast for discharge lamps in accordance with an embodiment 24 of the present invention.

(Embodiment 24):

The present embodiment 24 corresponds to a specific circuit of the arrangement of FIG. 20*b* of the embodiment 11, wherein, as shown in FIG. 47, the inverter section includes a second resonance circuit as in the embodiment 22. With such a circuit configuration, when the supply power to the discharge lamp La is decreased, the voltage across the primary winding of the transformer T2 increases. When the supply power to the discharge lamp La is decreased, the variable impedance Z ( of the transformer T2 and capacitors C7 and C8) can be made large. That is, the voltage across the capacitor C7 can be made low in the preheating mode; whereas the voltage can be made high in the dimming mode. Since the supply power to the filaments F1 and F2 can be controlled according to whether the lamp is in the preheating mode or in the dimming mode in this way, stable operating can be realized. Other arrangement and operation are substantially the same as those of the embodiment 22.

Figure 48:
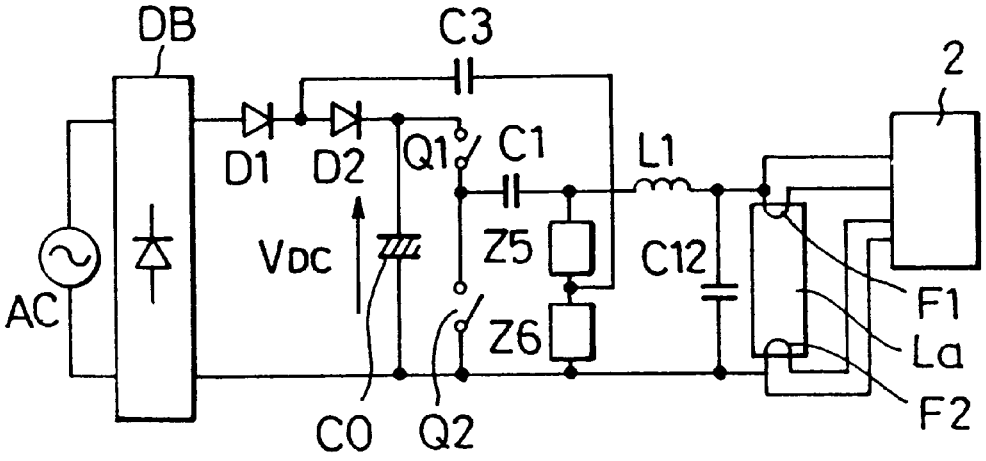
FIG. 48 is a circuit diagram of an electronic ballast for discharge lamps in accordance with an embodiment 25 of the present invention.

(Embodiment 25):

Even the present embodiment 25, which has substantially the same basic arrangement and operation as those of the embodiment 19, is featured in that, as shown in FIG. 48, a series circuit of a second impedance element Z5 and a third impedance element Z6 is connected in parallel to a series circuit of the inductor L1 and capacitor C12, and the capacitor C3 is connected between a junction point of the both impedance elements Z5 and Z6 and a junction point of the both diodes D1 and D2. In the present embodiment, the voltage Va at the junction point of the impedance elements Z5 and Z6 as a feedback power can be set independently of the lamp voltage V1*a* (voltage appearing between the power-side ends of the discharge lamp La), so that, when the impedances of the both impedance elements Z5 and Z6 are suitably selected, the amplitude of the voltage Va can be made small to suppress an increase in the voltage VDC across the smoothing capacitor C0 in the dimming mode or in the preheating mode.

Figure 49A:
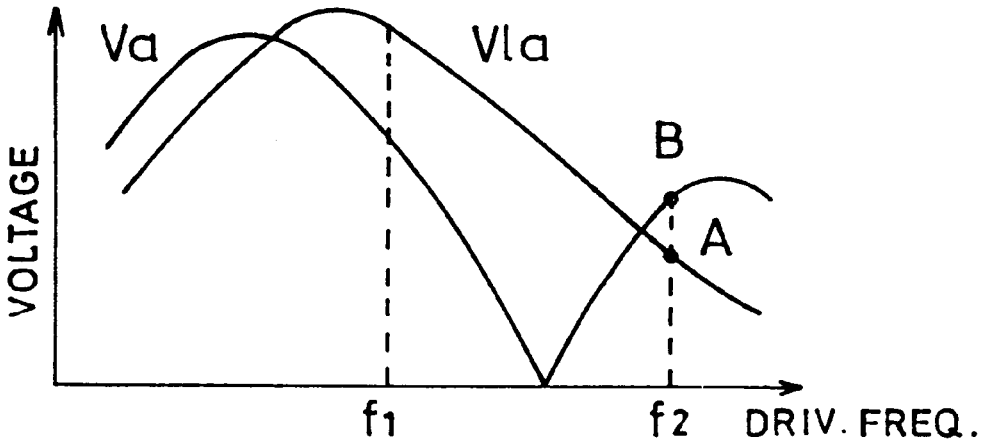
FIG. 49 is a frequency characteristic diagram of the embodiment 25 of FIG. 48.

The present embodiment is effective when such a lamp having a large supply power to the filaments and the prescribed upper limit of the then voltage between the lamp electrodes in the preheating mode as the T5 lamp is used as a load. For example, when the impedance elements Z5 and Z6 are selected so that the frequency characteristics of the voltage V1*a* and Va are as shown in FIG. 49*a*, the voltage V1*a* and Va can be independently set. In this connection, the operating frequency f2 of the switching elements Q1 and Q2 at the time of preheating the filaments F1 and F2 is set at such a value that a point A in FIG. 49 (*a*) is below the upper limit of the voltage V1*a* between the lamp electrodes and the voltage Va has an amplitude that can suppress an increase in the voltage VDC. Shown in FIG. 49(*b*) is a frequency characteristic of the filament current in the present embodiment.

Figure 49B:
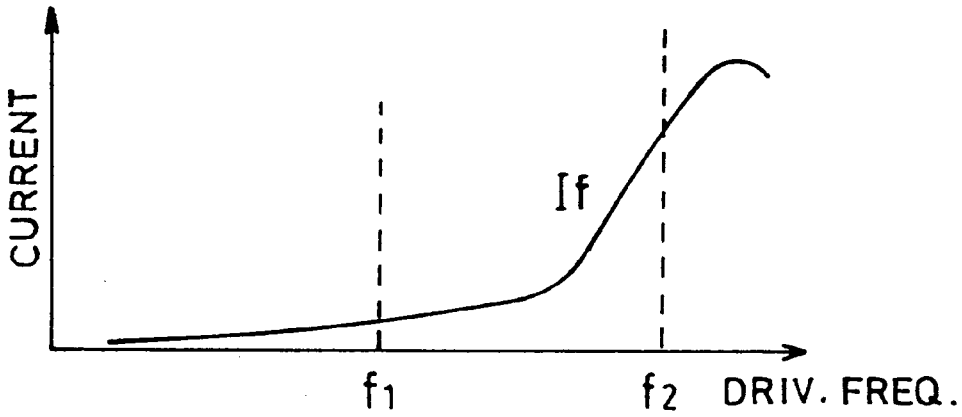
Figure 50:
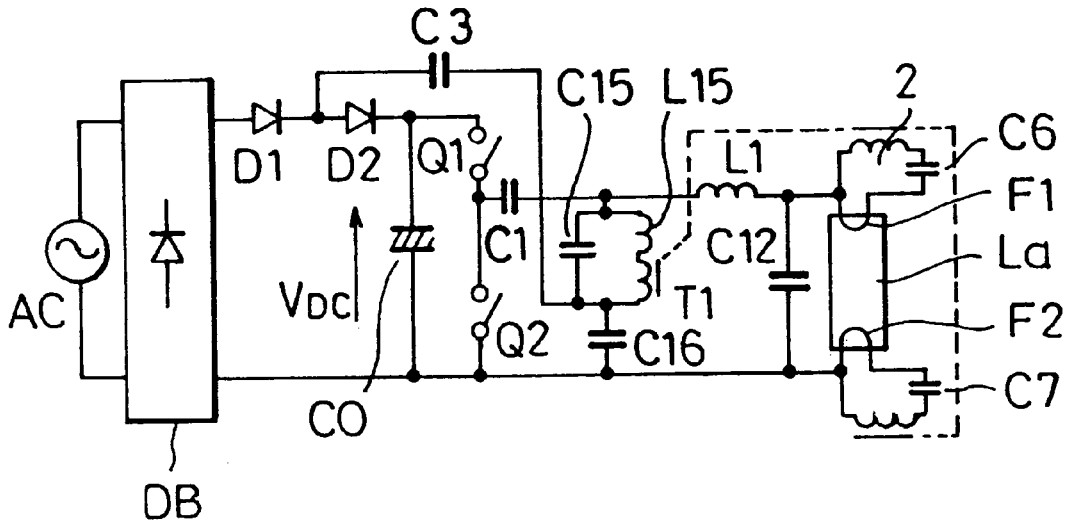
FIG. 50 is a circuit diagram of another modification of the embodiment of FIG. 48.

The circuit shown in FIG. 50, which is a detailed version of the circuit of FIG. 48, includes a series circuit of the inductor L15 and the primary winding of the transformer T1, a capacitor C15 connected in parallel to the series circuit to form the impedance element Z5, and a capacitor C16 to form the impedance element Z6. In the filament resonance circuit 2, the two secondary windings of the transformer T1 are connected to the filaments F1 and F2 of the discharge lamp La through the capacitors C6 and C7 respectively. The circuit configuration of FIG. 50 enables achievement of such frequency characteristics as shown in FIGS. 49(*a*) and 49(*b*).

Figure 51:
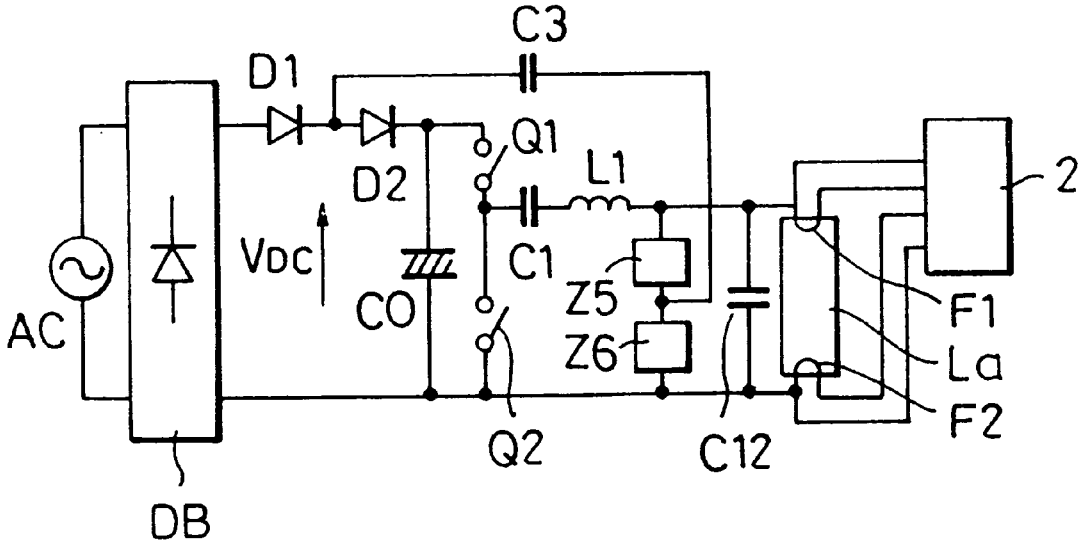
FIG. 51 is a circuit diagram of an electronic ballast for discharge lamps in accordance with an embodiment 26 of the present invention.

(Embodiment 26):

The present embodiment 26 has substantially the same basic arrangement and operation as those of the embodiments 19 and 25, but is different therefrom in that, as shown in FIG. 51, a series circuit of the impedance elements Z5 and Z6 is connected in parallel to the capacitor C12, and the capacitor C3 is connected to a junction point of the both impedance elements Z5 and Z6.

Even in the present embodiment, as in the embodiment 25, the feedback voltage Va can be set independently of the lamp voltage V12 between the power-side ends of the discharge lamp La, so that, when the impedance elements Z5 and Z6 are suitably selected, the amplitude of the voltage Va can be reduced and an increase in the voltage VDC can be suppressed in the dimming mode or in the prior preheating mode. Further, the present embodiment is effective when such a lamp having a large supply power to the filaments and the prescribed upper limit of the voltage between the lamp electrodes in the prior preheating mode as the T5 lamp is used as a load.

Figure 52:
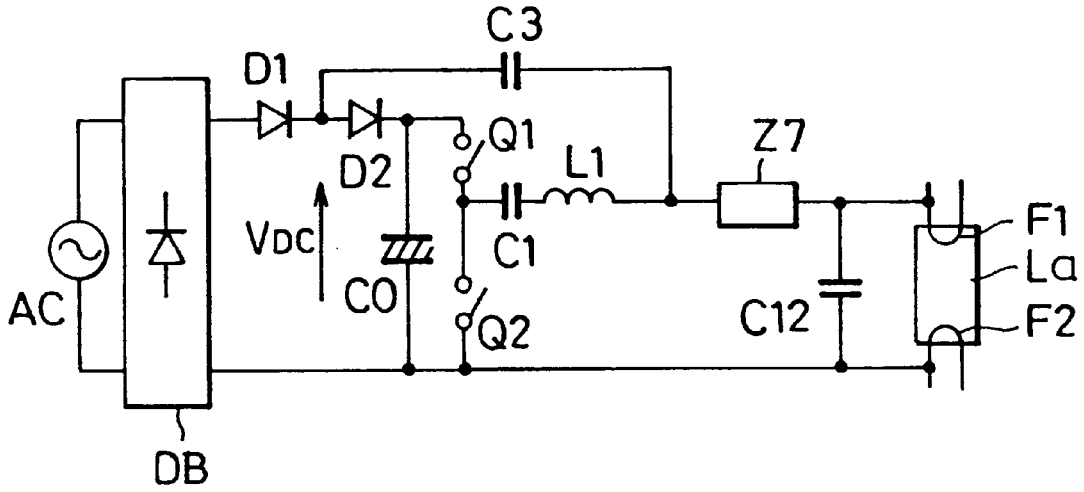
FIG. 52 is a circuit diagram of an electronic ballast for discharge lamps in accordance with an embodiment 27 of the present invention.

(Embodiment 27):

The present embodiment has substantially the same basic arrangement and operation as those of the embodiment 19, but is different therefrom in that, as shown in FIG. 52, a fourth impedance element Z7 is inserted between the inductor L1 and discharge lamp La, and the capacitor C3 is connected between the junction point of the diodes D1 and D2 and a junction point of the inductor L1 and fourth impedance element Z7. Even in the present embodiment, as in the embodiment 25, the feedback voltage Va can be set independently of the lamp voltage V1*a*, so that the amplitude of the voltage Va can be reduced in the preheating mode and thus an increase in the voltage VDC across the smoothing capacitor C0 can be suppressed. Even in the present embodiment, since such a lamp having a high lamp impedance per unit length as the T5 lamp is used as the discharge lamp La, the impedance of the capacitor C3 can be made large as in the embodiment 19 and thus a small size of capacitor C3 can be employed.

The filaments F1 and F2 of the discharge lamp La are connected with a filament preheating circuit (not shown), which corresponds to the filament resonance circuit 2 in the embodiments 19 to 21.

Figure 53:
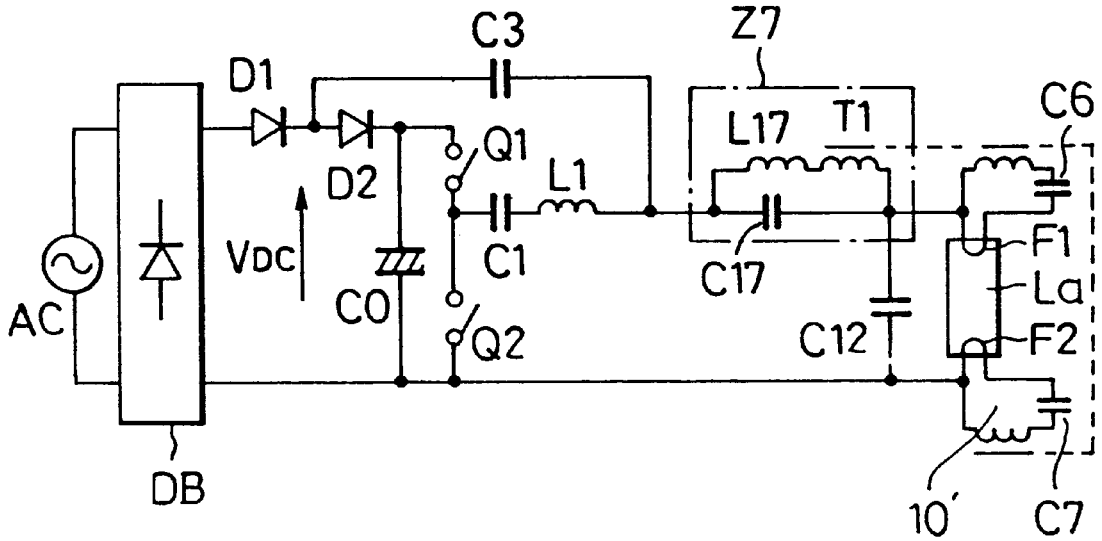
FIG. 53 is a circuit diagram of an electronic ballast for discharge lamps in accordance with an embodiment 28 of the present invention.

(Embodiment 28):

The present embodiment has such a circuit configuration as shown in FIG. 53, in which the fourth impedance element Z7 in the embodiment 27 is made up of a series circuit of the inductor L17 and the primary winding of the transformer T1, and a capacitor C17 connected in parallel to the above series circuit. In this case, the two secondary windings of the transformer T1 are connected to the filaments F1 and F2 through the capacitors C6 and C7 respectively.

The present embodiment is effective when such a lamp having a large supply power to the filaments and the prescribed upper limit of the then voltage between the lamp electrodes in the prior preheating mode as the T5 lamp is used as a load.

Figure 54A:
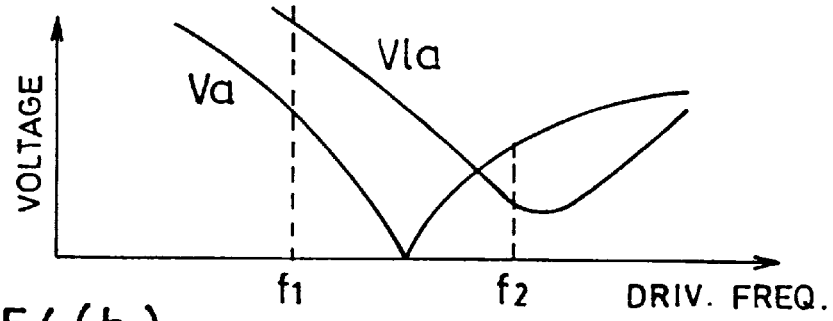
FIG. 54 is a frequency characteristic diagram of the embodiment 28 of FIG. 53.
Figure 54B:
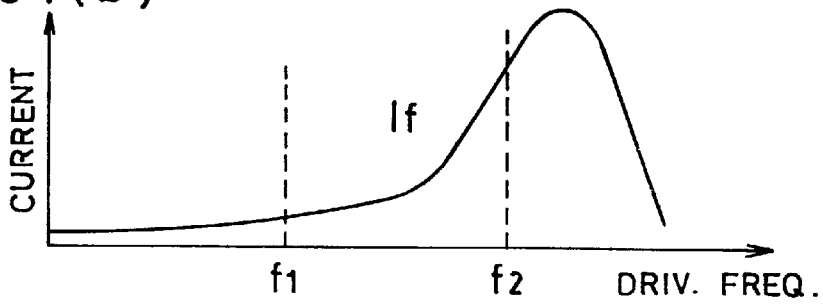

In the present embodiment, the lamp voltage V1*a* and the feedback voltage Va are set to have such frequency characteristics as shown in FIG. 54, parameters in the respective parts of the circuit are selected based on these frequency characteristics so that such a frequency (anitresonance frequency) as to provide the minimum voltage V1*a* is positioned in the vicinity of the preheating frequency f2, which results in that the voltage Va can be set to have such an amplitude as to suppress the upper limit of the voltage between the lamp electrodes.

In this connection, setting of antiresonance frequencies of the voltage Va and V1*a* enables the voltage Va to be set to have such an amplitude as to suppress an increase in the voltage across the smoothing capacitor CO.

Figure 55:
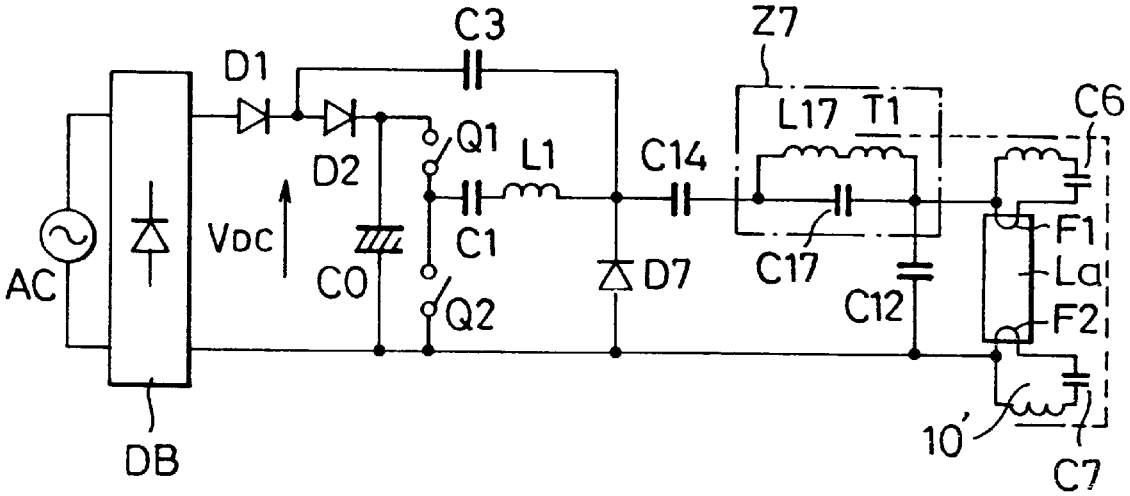
FIG. 55 is a circuit diagram of an electronic ballast for discharge lamps in accordance with an embodiment 29 of the present invention.

(Embodiment 29):

The present embodiment has such a circuit configuration as shown in FIG. 55. In this case, in place of providing the DC blocking capacitor C1 in the embodiment 28, the capacitor C14 is connected between the inductor L1 and fourth impedance element Z7, and a diode D7 is connected between a junction point of the inductor L1 and capacitor C14 and a source terminal of the switching element Q2, exhibiting substantially the same effects as those of the embodiment 28.

Although the present invention has been described in connection with the preferred embodiments thereof, it will be appreciated by those skilled in the art that addition, modifications, substitutions and deletions not specifically described may be made without departing from the spirit and scope of the invention as defined in the appended claims.

TABLE 1

| Lamp Name | Tube Diameter [mm] | Lamp Length [cm] | Lamp Impedance [Ω] | Lamp Impedance Per Unit Length [Ω/cm] |
|---|---|---|---|---|
| T5-14 | 16.0 | 54.0 | 488 | 8.89 |
| T5-21 | 16.0 | 84.9 | 724 | 8.52 |
| T5-28 | 16.0 | 114.9 | 976 | 8.50 |
| T5-35 | 16.0 | 144.9 | 1206 | 8.32 |
| FHF16 | 25.5 | 58.0 | 251 | 4.33 |
| FHF16-23 | 25.5 | 58.0 | 127 | 2.19 |
| FHF32 | 25.5 | 119.8 | 502 | 4.19 |
| FHF32-45 | 25.5 | 119.8 | 254 | 2.12 |
| FL15 | 25.5 | 43.6 | 183 | 4.20 |
| FL20S | 32.5 | 58.0 | 161 | 2.78 |
| FL20SS/18 | 28.0 | 58.0 | 174 | 2.99 |
| FL30S | 32.5 | 63.0 | 90 | 1.43 |
| FL40S/38 | 32.5 | 119.8 | 266 | 2.22 |
| FL40SS/37 | 28.0 | 119.8 | 263 | 2.20 |

What is claimed is:

1. An electronic ballast for discharge lamps comprising:

a main inverter including a plurality of switching elements and a main resonance circuit connected to an output path leading to a discharge lamp having a plurality filaments, for supplying a voltage necessary for operating of said discharge lamp by driving said plurality of switching elements; and a filament preheating inverter including a plurality of switching elements and a filament resonance circuit connected to an output path leading to a discharge lamp having a plurality of filaments for supplying a preheating current to said filaments by operating said plurality of switching elements;

wherein output frequency characteristics of said main inverter and filament preheating inverter are set so that an operating frequency f2 of said filament preheating inverter when the filament current in a dimming mode of said discharge lamp reaches a predetermined upper limit becomes equal to or higher than an operating frequency f1 of said main inverter when an optical output in a dimming mode of the discharge lamp becomes a lower limit.

2. An electronic ballast for discharge lamps as set forth in claim 1, wherein the output frequency characteristics of said main inverter and filament inverter are set so that an operating frequency f4 of said filament inverter when the filament current in a preheating mode reaches a lower limit becomes larger than an operating frequency f3 of said main inverter when said discharge lamp voltage becomes an ignition voltage in said preheating mode.

3. An electronic ballast for discharge lamps as set forth in claim 1, wherein the output frequency characteristics of said main inverter and filament preheating inverter are set so that the operating frequency f4 of said filament preheating inverter when the filament current in a preheating mode reaches a lower limit becomes equal to or higher than the operating frequency f2 of said filament preheating inverter when a filament current in a dimming mode of said discharge lamp reaches a predetermined upper limit and so that said operating frequency f4 becomes larger than the operating frequency f3 of said main inverter when said discharge lamp voltage becomes an ignition voltage in said preheating mode.

4. An electronic ballast for discharge lamps as set forth in claim 1, wherein said main inverter and filament inverter share an input power supply and said plurality of switching elements.

5. An electronic ballast for discharge lamps as set forth in claim 4, wherein said filament inverter includes a transformer having a primary winding inserted in a resonance current path of said main inverter and having a secondary winding for supplying said filament current therefrom.

6. An electronic ballast for discharge lamps as set forth in claim 1, comprising the main inverter for applying a voltage necessary for operating of the discharge lamp having the filaments to both ends of the discharge lamp and the filament inverter for supplying a filament current to the filaments, and wherein said filament inverter uses as a power supply a voltage across an element connected in series with the discharge lamp in said main inverter, and said main inverter varies its output according to ON duty cycles of said plurality of switching elements.

7. An electronic ballast for discharge lamps as set forth in claim 1, comprising the main inverter for applying a voltage necessary for operating of the discharge lamp having the filaments to both ends of the discharge lamp and the filament inverter for supplying a filament current to the filaments, and wherein said main inverter and filament inverter have resonance circuits having different resonance characteristics in an output path leading to the discharge lamp, said main inverter varies its output according to ON duty cycles of said plurality of switching elements, said filament inverter varies its output according to an operating frequency of the plurality of switching elements, and output characteristics of said main inverter and filament inverter are set so that the operating frequency of said main inverter in the dimming mode of the discharge lamp is lower than the operating frequency of said filament inverter in the preheating mode of the discharge lamp.

8. An electronic ballast for discharge lamps as set forth in claim 1, comprising the main inverter for applying a voltage necessary for operating of the discharge lamp having the filaments to both ends of the discharge lamp, the filament inverter for supplying a filament current to the filaments, and a voltage regulation circuit for supplying a variable output voltage as an input voltage of said main inverter and filament inverter, and wherein the output voltage of said voltage regulation circuit is changed to control the filament current.

9. An electronic ballast for discharge lamps as set forth in claim 1, comprising an inverter circuit for supplying a high frequency power to the discharge lamp having the filaments to operate the lamp and a series circuit of a capacitor and a variable impedance, connected between non-power-side ends of the filaments to form a resonance circuit, and wherein said variable impedance can control a voltage thereacross, and the voltage across said variable impedance is changed to control the filament current to be sent to the filaments.

10. An electronic ballast for discharge lamps as set forth in claim 1, comprising an inverter circuit for supplying a high frequency power to the discharge lamp having the filaments to operate the lamp, said inverter circuit changing its output according to the operating frequency of the switching elements, and a series circuit of a capacitor and a primary winding of a transformer, connected between non-power-side ends of the filaments to form a resonance circuit, and wherein a secondary winding of said transformer is connected to said filaments.

11. An electronic ballast for discharge lamps as set forth in claim 1, comprising an inverter circuit for outputting an A.C. output containing a plurality of frequency components, a first filter inserted between the discharge lamp having the filaments and said inverter circuit, and a second filter inserted between a filament current path leading to the filaments and said inverter circuit, and wherein the frequency components of the A.C. output of the inverter circuit are controlled to separately control a voltage to be applied to both ends of the discharge lamp and a voltage to be applied to the filaments.

12. An electronic ballast for discharge lamps as set forth in claim 11, wherein output control of said inverter circuit is based on pulse width modulation.

13. An electronic ballast for discharge lamps as set forth in claim 11, wherein output control of said inverter circuit is based on pulse density modulation.

14. An electronic ballast for discharge lamps as set forth in claim 11, wherein output control of said inverter circuit is based on ON duty cycle.

15. An electronic ballast for discharge lamps as set forth in claim 1, wherein the frequency characteristic of said main inverter is changed between the preheating mode and dimming mode of said discharge lamp so that the operating frequency of said filament preheating inverter when the filament current in the dimming mode of the discharge lamp reaches a predetermined upper limit becomes equal to or higher than the operating frequency of said main inverter when an optical output of the discharge lamp in the dimming mode becomes a lower limit.

16. An electronic ballast for discharge lamps as set forth in claim 1, wherein said main inverter includes a full-wave rectifier for full-wave rectifying an A.C. power, a smoothing capacitor connected between output terminals of said full-wave rectifier through a diode for smoothing a D.C. output voltage of said full-wave rectifier, a conversion circuit for converting a voltage across said smoothing capacitor to a high frequency voltage and for supplying said high frequency voltage to the discharge lamp through a main resonance circuit, and feedback means for feeding part of said high frequency voltage back to said smoothing capacitor through said diode.

17. An electronic ballast for discharge lamps as set forth in claim 1, wherein said main inverter includes a full-wave rectifier for full-wave rectifying an A.C. power, a smoothing capacitor connected between output terminals of said full-wave rectifier through a diode, a conversion circuit having a series circuit of two switching elements connected between the both ends of said smoothing capacitor and also having a main resonance circuit connected across one of said switching elements, and an impedance element connected at its one end between an output terminal of said full-wave rectifier and said diode and also connected at the other end to an output side of said conversion circuit, and wherein part of an output voltage of said conversion circuit is fed back to said smoothing capacitor through said impedance element and diode.

18. An electronic ballast for discharge lamps as set forth in claim 1, wherein said filament preheating inverter includes a full-wave rectifier for full-wave rectifying an A.C. power, a smoothing capacitor connected between output terminals of said full-wave rectifier through a diode for smoothing a D.C. output voltage of said full-wave rectifier, a conversion circuit for converting a voltage across said smoothing capacitor to a high frequency voltage and for supplying said high frequency voltage to the discharge lamp through a filament resonance circuit, and feedback means for feeding part of said high frequency voltage back to said smoothing capacitor through said diode.

19. An electronic ballast for discharge lamps as set forth in claim 1, wherein said filament preheating inverter includes a full-wave rectifier for full-wave rectifying an A.C. power, a smoothing capacitor connected between output terminals of said full-wave rectifier through a diode, a conversion circuit having a series circuit of two switching elements connected between the both ends of said smoothing capacitor and also having a filament resonance circuit connected across one of said switching elements, and an impedance element connected at its one end between an output terminal of said full-wave rectifier and said diode and also connected at the other end to an output side of said conversion circuit, and wherein part of an output voltage of said conversion circuit is fed back to said smoothing capacitor through said impedance element and diode.

20. An electronic ballast for discharge lamps as set forth in claim 1, wherein a second LC resonance circuit is inserted between said main resonance circuit and discharge lamp, and an output of said main resonance circuit is used as a feedback power and is also supplied to the discharge lamp through said second LC resonance circuit.

21. An electronic ballast for discharge lamps as set forth in claim 1, wherein a series circuit of second and third impedance elements forming a third LC resonance circuit is connected between the output ends of said main inverter in parallel thereto to use a voltage at a junction point of said second and third impedance elements as a feedback power.

22. An electronic ballast for discharge lamps as set forth in claim 1, wherein a fourth impedance element is connected between said main resonance circuit and discharge lamp to use an output of said main resonance circuit as a feedback power.

23. An electronic ballast for discharge lamps as set forth in claim 22, wherein said fourth impedance element includes an LC parallel/resonance circuit, the output frequency characteristic of said main inverter is set so that an output voltage of the main inverter becomes nearly its minimum at the operating frequency of the switching elements in the preheating mode of the discharge lamp.

24. An electronic ballast for discharge lamps as set forth in claim 1, wherein said discharge lamp is a fluorescent lamp having a lamp impedance of 8Ω/cm or more per unit length excluding lamp caps.

25. An electronic ballast for discharge lamps comprising:

a discharge lamp having a lamp impedance of 8Ω/cm or more per unit length excluding lamp caps;

a rectifier connected at its input and with an A.C. power source;

a smoothing capacitor connected between output ends of said rectifiers;

a series circuit of 2 switching elements connected between both ends of said smoothing capacitor;

an inductor connected across of one of said two switching elements through the discharge lamp;

a series circuit of a first capacitor and a primary winding of a transformer connected between power-side terminals of the discharge lam;

a series circuit of a first secondary winding of the transformer and a second capacitor connected between ones of filaments of the discharge lamp; and a series circuit of a second secondary winding of the transformer and a third capacitor connected between the other filaments of the discharge lamp;

wherein at least said inductor and first capacitor form a main resonance circuit, at least an inductance of the transformer and said second capacitor form a first filament resonance circuit, at least the inductance of the transformer and said third capacitor form a second filament resonance circuit;

wherein output frequency characteristics of said main resonance circuit and first and second filament resonance circuits are set so that an operating frequency f2 of said switching elements when the filament current in a dimming mode of said discharge lamp reaches a predetermined upper limit becomes equal to or higher than an operating frequency f1 of said switching elements when an optical output in a dimming mode of the discharge lamp becomes a lower limit, and so that the operating frequency f4 of said switching elements when the filament current in a preheating mode reaches a lower limit becomes equal to or higher than the operating frequency f2, and so that said operating frequency f4 becomes larger than the operating frequency f3 of said switching elements when said discharge lamp voltage becomes an ingition voltage in said preheating mode.

26. An electronic ballast for discharge lamps comprising:

a discharge lamp having a lamp impedance of 8Ω/cm or more per unit length excluding lamp caps;

a rectifier connected at its input end with an A.C. power source;

a smoothing capacitor connected between output ends of said rectifier through a diode;

a series circuit of 2 switching elements connected between both ends of said smoothing capacitor;

an inductor connected across of one of said two switching elements through the discharge lamp;

a series circuit of a first capacitor and a primary winding of a transformer connected between power-side terminals of the discharge lamp;

a series circuit of a first secondary winding of the transformer and a second capacitor connected between ones of filaments of the discharge lamp;

a series circuit of a second secondary winding of the transformer and a third capacitor connected between the other filaments of the discharge lamp; and a fourth capacitor connected between a junction point of said rectifier and diode and a junction point of said inductor and first capacitor;

wherein at least said inductor and first capacitor form a main resonance circuit, at least an inductance of the transformer and said second capacitor form a first filament resonance circuit, at least the inductance of the transformer and said third capacitor form a second filament resonance circuit;

wherein output frequency characteristics of said main resonance circuit and first and second filament resonance circuits are set so that an operating frequency f2 of said switching elements when the filament current in a dimming mode of said discharge lamp reaches a predetermined upper limit becomes equal to or higher than an operating frequency f1 of said switching elements when an optical output in a dimming mode of the discharge lamp becomes a lower limit, and so that the operating frequency f4 of said switching elements when the filament current in a preheating mode reaches a lower limit becomes equal to or higher than the operating frequency f2, and so that said operating frequency f4 becomes larger than the operating frequency f3 of said switching elements when said discharge lamp voltage becomes an ignition voltage in said preheating mode.

27. An electronic ballast for discharge lamps comprising:

a discharge lamp having a lamp impedance of 8Ω/cm or more per unit length excluding lamp caps;

a rectifier connected at its input end with an A.C. power source;

a smoothing capacitor connected between output ends of said rectifier through a diode;

a series circuit of 2 switching elements connected between both ends of said smoothing capacitor;

a series circuit of first and second inductors connected across of one of said two switching elements through the discharge lamp;

a first capacitor connected to both ends of the discharge lamp through said second inductor;

a series circuit of a second capacitor and a primary winding of a transformer connected between power-side terminals of the discharge lamp;

a series circuit of a first secondary winding of the transformer and a third capacitor connected between ones of filaments of the discharge lamp;

a series circuit of a second secondary winding of the transformer and a fourth capacitor connected between the other filaments of the discharge lamp; and a fifth capacitor connected between a junction point of said rectifier and diode and a junction point of said first inductor and first capacitor;

wherein at least said first and second inductors and first and second capacitors form a first main resonance circuit, at least an inductance of the transformer and said third capacitor form a first filament resonance circuit, at least the inductance of the transformer and said fourth capacitor form a second filament resonance circuit;

wherein output frequency characteristics of said main resonance circuit and first and second filament resonance circuits are set so that an operating frequency f2 of said switching elements when the filament current in a dimming mode of said discharge lamp reaches a predetermined upper limit becomes equal to or higher than an operating frequency f1 of said switching elements when an optical output in a dimming mode of the discharge lamp becomes a lower limit, and so that the operating frequency f4 of said switching elements when the filament current in a preheating mode reaches a lower limit becomes equal to or higher than the operating frequency f2, and so that said operating frequency f4 becomes larger than the operating frequency f3 of said switching elements when said discharge lamp voltage becomes an ignition voltage in said preheating mode.

* * * * *